US007954648B2

(12) United States Patent
Takashima et al.

(10) Patent No.: US 7,954,648 B2
(45) Date of Patent: Jun. 7, 2011

(54) CIGARETTE DISPLAY SYSTEM

(75) Inventors: Norikazu Takashima, Tokyo (JP); Norihiro Haneda, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 179 days.

(21) Appl. No.: 12/443,267

(22) PCT Filed: Sep. 28, 2007

(86) PCT No.: PCT/JP2007/001052

§ 371 (c)(1),
(2), (4) Date: Mar. 27, 2009

(87) PCT Pub. No.: WO2008/041359

PCT Pub. Date: Apr. 10, 2008

(65) Prior Publication Data

US 2010/0012603 A1 Jan. 21, 2010

(30) Foreign Application Priority Data

Sep. 29, 2006 (JP) ..... 2006-266629

(51) Int. Cl.
*A47F 1/04* (2006.01)

(52) U.S. Cl. ..... 211/59.3; 211/88.01; 211/94.01

(58) Field of Classification Search ..... 211/59.3, 211/59.4, 90.02, 94.01, 88.01, 88.02, 106.01
See application file for complete search history.

(56) References Cited

U.S. PATENT DOCUMENTS

| | | | | |
|---|---|---|---|---|
| 4,509,648 | A * | 4/1985 | Govang et al. | 211/70.6 |
| 4,537,316 | A * | 8/1985 | Simon et al. | 211/133.3 |
| 4,705,175 | A * | 11/1987 | Howard et al. | 211/59.2 |
| 5,318,187 | A * | 6/1994 | Rosenthal | 211/88.01 |
| 5,439,106 | A * | 8/1995 | Focke | 206/273 |
| 5,944,203 | A * | 8/1999 | Vlah et al. | 211/189 |
| 6,364,136 | B1 * | 4/2002 | Weshler et al. | 211/90.02 |
| 6,454,107 | B1 * | 9/2002 | Belanger et al. | 211/59.3 |
| 6,547,084 | B2 * | 4/2003 | Bauman et al. | 211/71.01 |
| 6,883,671 | B2 * | 4/2005 | Rushing | 211/88.01 |
| 6,935,518 | B2 * | 8/2005 | Winig et al. | 211/90.02 |
| 7,175,034 | B2 * | 2/2007 | Nook et al. | 211/189 |
| 7,201,281 | B1 * | 4/2007 | Welker | 211/59.3 |

FOREIGN PATENT DOCUMENTS

| | | | |
|---|---|---|---|
| JP | 53-3118 | U | 1/1978 |
| JP | 64-056014 | A | 3/1989 |
| JP | 2-141259 | U | 11/1990 |
| JP | 10-151047 | A | 6/1998 |
| JP | 2002-282099 | A | 10/2002 |
| JP | 2005-334326 | A | 12/2005 |

* cited by examiner

*Primary Examiner* — Korie Chan
(74) *Attorney, Agent, or Firm* — Birch, Stewart, Kolasch & Birch, LLP

(57) ABSTRACT

In a cigarette display system 1000, a plurality of wall units 500 can be linked in an vertical direction, and tray units 200 can be arranged in desired positions on a front surface of the wall units 500. Each of the tray units 200 can hold a plurality of magazine units 100 arranged in a lateral direction, and each of the magazine units 100 can hold a plurality of cigarette packs T arranged in a direction from front to back. Accordingly, it is possible to freely change a layout in which the cigarette packs T are arranged and displayed in the vertical and lateral directions so that cigarette cartons K or the like having a shape which cannot be accommodated in the magazine unit 100 can be displayed as well. As described above, the present invention provides the cigarette display system 1000 having a structure in which the layout of the cigarette packs T to be displayed or the like can be changed in various forms.

15 Claims, 28 Drawing Sheets

(a)

(b)

(a)

(b)

(a)

(b)

(a)

(b)

(a)

(b)

CIGARETTE DISPLAY SYSTEM

TECHNICAL FIELD

The present invention relates to a cigarette display system for displaying cigarette packs to be sold, and more particularly the present invention relates to a cigarette display system placed in a convenience store, and the like.

BACKGROUND ART

Cigarette packs are currently displayed and sold in stores such as so-called convenience stores. The "cigarette pack" mentioned here does not mean a cigarette which is actually smoked, but means a rectangular solid package which accommodates a plurality of cigarettes.

The cigarette display system for displaying cigarette packs includes a plurality of magazine units and a system frame, for example. The magazine unit is formed in the shape of a box which is elongated in a direction from front to back and has an opened top, using a colorless, transparent resin, for example.

The magazine unit can then accommodate upright cigarette packs arranged in the direction from front to back, which are provided from above. A slider member is attached to the magazine unit on its bottom surface so as to be slidable in a direction from front to back.

More specifically, at the bottom of the magazine unit, an elongated opening is formed in a direction from front to back. Upward-protruded ribs are formed on both left and right sides of the opening. The slider member is attached to the pair of ribs and the opening so as to be slidable in a direction from front to back.

A wound plate spring to serve as an urging mechanism is attached at a rear of the slider member. One end of the plate spring is pulled out from the slider member and attached to a front bottom part of the magazine unit.

Accordingly, a slider member, which is slidable in a direction from front to back, is resiliently urged by the plate spring. Therefore, a plurality of cigarette packs accommodated in the magazine unit is pushed to a forefront by the slider member.

The system frame holds a plurality of magazine units arranged in the vertical and lateral directions. The system frame includes a plurality of guide rails and a single main frame. A pair of guide rails holds both sides of the magazine unit. The main frame is formed by, for example, metal bars in a solid shape. The plurality of guide rails is fixed in pairs to key points of the main frame.

In the cigarette display system as mentioned above, for example, 20 magazine units are mounted in the system frame in an array of 4 rows and 5 columns. For example, 10 cigarette packs are accommodated in each of the magazine units.

In such the cigarette display system, since cigarette packs are accommodated in colorless, transparent magazine units while the cigarette packs are in an upright state, the cigarette packs are displayed while their representative surfaces facing the front. Therefore, in the cigarette display system, it is possible to display 20 types of cigarette packs, while 10 packs for each kind are accommodated, for example.

When selling a cigarette pack, the cigarette pack is pulled out upward from the forefront part of the magazine unit and remaining cigarette packs accommodated in the magazine unit are pushed to the front by the slider member. Thereby, the magazine unit may keep the state of displaying the cigarette packs at the forefront position, even after one cigarette pack is pulled out.

When replenishing cigarette packs in the cigarette display system, a magazine unit is detached from the system frame.

Cigarette packs are accommodated in the magazine unit, and the magazine unit having the cigarette packs accommodated therein is mounted in the system frame. Therefore, it is not necessary to perform a troublesome operation for replenishing cigarette packs in a magazine unit fixed in the system frame.

In a cigarette display system as mentioned above, it is possible to wash and clean a magazine unit, by detaching the magazine unit from the system frame, for example.

[Patent Document 1]

Japanese Laid-open patent publication NO. 10-151047

DISCLOSURE OF THE INVENTION

Problems to be Solved by the Invention

The conventional cigarette display systems are fixed in the overall shape. For this reason, if the space for installing the system is small, the cigarette display system may not be installable. On the other hand, if the space for installing the system is large, a dead space may be created.

In short, the conventional cigarette display system cannot flexibly adapt to various types of installation space. Thereby, it is not possible to set up an effective sales space while optimizing a store space.

Therefore, conventional stores could not display cigarette packs in various ways. Thereby, stores have not set up a highly-appealing sales space by strategically designing modes of displaying cigarette packs, and companies which provide cigarette packs to stores have been unable to propose various modes of display.

Furthermore, the conventional cigarette display systems have been enlarged in order to display a sufficient quantity of cigarette packs. Therefore, the conventional cigarette display systems are generally heavy. It is therefore not easy to bring in and install the system in a store.

For example, many convenience stores operate 24 hours a day. The cigarette display system therefore needs to be brought in and installed while the store is opened. In other words, the cigarette display system needs to be brought in and installed quickly in a space-saving manner. However, this is difficult so far as the conventional cigarette display systems are used.

Further, conventionally, for example, advertisement units are attached to the cigarette display system to display cigarette packs to customers in an appealing manner. In other words, conventionally, advertisement units are required to display the cigarette packs in a more appealing manner.

As mentioned in the above, it is difficult to readily and quickly bring in and install the conventional cigarette display systems, and there is no flexibility with regards to installation and the modes of display of the cigarette packs. Therefore, it is impossible to set up a highly-appealing space of sales so far as the conventional cigarette display systems are used.

The cigarette display system as mentioned above is, for example, installed on a counter in a store. As a result, a customer is positioned in front of the cigarette display system, and a store clerk is positioned behind the cigarette display system.

In such case, there is a need for using the cigarette display system as a partition. However, the conventional cigarette display system cannot function as a partition because magazine units are arranged separately in the vertical and lateral directions.

The cigarette display system may be installed along a wall surface of the store. In that case, from point of view of appearance or the like, it may be required that the wall surface is covered with the cigarette display system so that the wall surface is not shown to the customers. However, with the conventional cigarette display system, the wall surface is shown through gaps between magazine units as mentioned above.

In short, it is difficult for the conventional cigarette display systems to function as a partition and cover a wall surface. Therefore, it is impossible to set up a highly-appealing space of sales so far as the conventional cigarette display systems are used.

The present invention was accomplished considering the above problems, and provides a cigarette display system allowed for various modifications in the overall shape or in the layout of cigarette packs to be displayed.

Means for Solving the Problems

According to the present invention, there is provided a cigarette display system for displaying cigarette packs to be sold, the system including: a plurality of magazine units formed in the shape of a box which is elongated in a direction from front to back and having an opened top, the magazine units having a shape which allows a plurality of cigarette packs to be held therein while being arranged in the direction from front to back; a plurality of tray units formed in the shape of a box having an opened top, the tray units having a shape which allows a plurality of the magazine units arranged in the lateral direction to be held detachably; a plurality of wall units which is formed in a flat plate shape flattened in a direction from front to back and has a front surface on which recesses and protrusions of a predetermined shape are formed; a wall link mechanism for linking a plurality of the wall units in the vertical direction; and a plurality of tray attachments including an engagement mechanism for detachably engaging with the recesses and protrusions of the wall units, and a support frame for detachably holding the tray unit.

Therefore, in the cigarette display system of the present invention, a plurality of wall units can be linked in the vertical direction by the wall link mechanism, and the tray units can be attached to the front surface of the wall units by the tray attachments. Each of the tray units can hold a plurality of magazine units arranged in the lateral direction, and each of the magazine units can hold a plurality of cigarette packs arranged in a direction from front to back. Therefore, it is possible to display a plurality of types of cigarette packs by arranging cigarette packs of each kind in a direction from front to back and then arranging such arranged cigarette packs in the vertical and lateral directions.

In this case, the number and arrangement of the magazine units held by the tray unit, the number and arrangement of the tray units attached to the wall units, the number of the wall units linked in the vertical, up-down, direction, the number of the wall units arranged in the lateral, left-right, direction can be freely changed. Therefore, a layout in which cigarette packs are arranged and displayed in the vertical and lateral directions can be freely changed. The cigarette display system can be easily and quickly brought in and installed in a store. In addition, since there is flexibility in the site of installation and the mode of display of the cigarette packs, it is possible to set up a highly-appealing space. Especially, the wall unit functions as a partition. Therefore, it is possible to favorably display cigarette packs to customers while favorably separating positions of customers and store clerks. Further, when installing the cigarette display system along a wall surface, it is possible to display the cigarette packs in a more appealing manner by making a condition in which customers cannot see the wall surface.

Although the present invention defines a direction from front to back and a lateral direction in addition to a vertical direction, these are definitions of convenience to simply explain relative relationships between components of the present invention, and do not limit the directions upon producing or using the cigarette display system in the practice of the present invention.

Further, the components of the present invention are not necessarily independent entities. It is possible that a plurality of components may be formed as a single member, a single component may be formed as a plurality of members, a component may be a part of another component, and a part of a component may overlap a part of another component.

BRIEF DESCRIPTION OF THE DRAWINGS

The objects mentioned above, and other objects, characteristics, and advantages are further revealed by a preferred embodiment to be mentioned below, and the following accompanying drawings thereof.

BEST MODE FOR CARRYING OUT THE INVENTION

Figure 1:
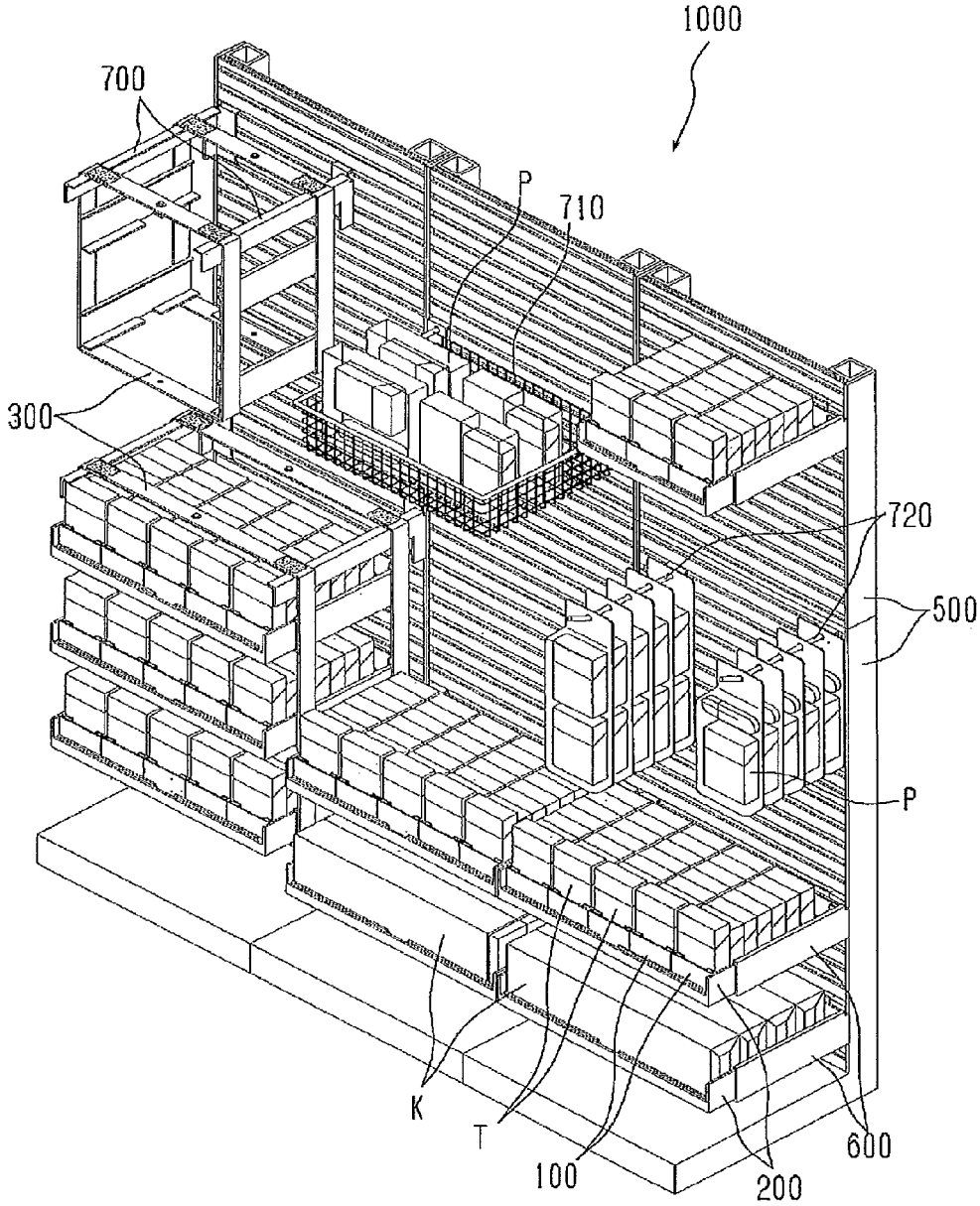
FIG. 1 is a perspective view showing an appearance of a cigarette display system of an embodiment of the present invention.

An embodiment of the present invention will be described with reference to the drawings. As shown in FIG. 1, a cigarette display system 1000 of the embodiment is used to display cigarette packs T to be sold.

In order for this, as shown in FIG. 1 and each figure, the cigarette display system 1000 includes: a plurality of magazine units 100 formed in the shape of a box which is elongated in a direction from front to back and having an opened top, the magazine units 100 having a shape which allows a plurality of cigarette packs T to be held therein while being arranged in the direction from front to back; a plurality of tray units 200 formed in the shape of a box having an opened top, the tray units 200 having a shape which allows a plurality of the magazine units 100 arranged in the lateral direction to be held detachably; a plurality of wall units 500 which is formed in a flat plate shape flattened in a direction from front to back and has a front surface on which recesses and protrusions of a predetermined shape are formed; metal pipes 531, 532, which serves as wall link mechanisms, for linking the plurality of wall units 500 in a vertical direction; and a plurality of tray attachments 600 including an engagement mechanism 630 for detachably engaging with the recesses and protrusions of the wall units, and a support frame 610 for detachably holding the tray unit 200.

More specifically, the cigarette display system 1000 displays the cigarette packs T, cigarette cartons K in each of which a plurality of cigarette packs T are packed, campaign packs P in each of which a cigarette pack T and a free gift are packed together, and the like. The campaign packs P are provided to a store with simple fittings F formed by cardboard, for example.

At present, the cigarette packs T are formed in a rectangular solid shape, which generally has a common length from front to back and lateral width, whilst heights are not uniform. In the embodiment, it is defined that largest surfaces of the cigarette pack T are a front surface and a back surface, and smallest surfaces are a top surface and a bottom surface.

Figure 2:
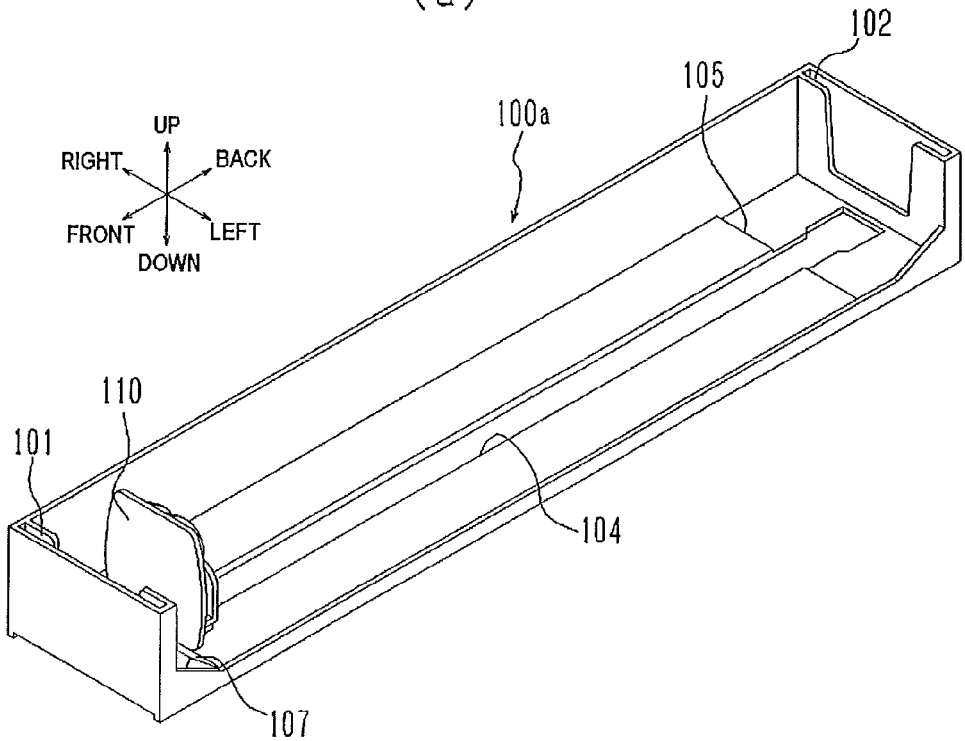
FIG. 2 is a perspective view showing appearances of two types of magazine units.
Figure 2:
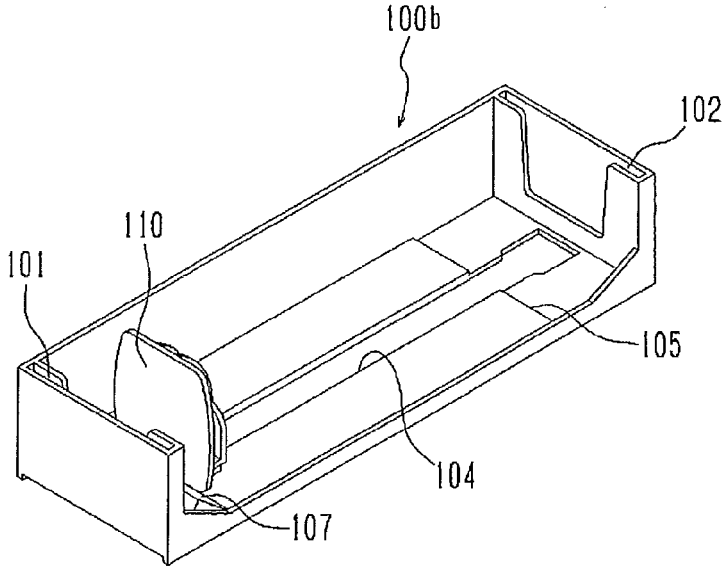
Figure 3:
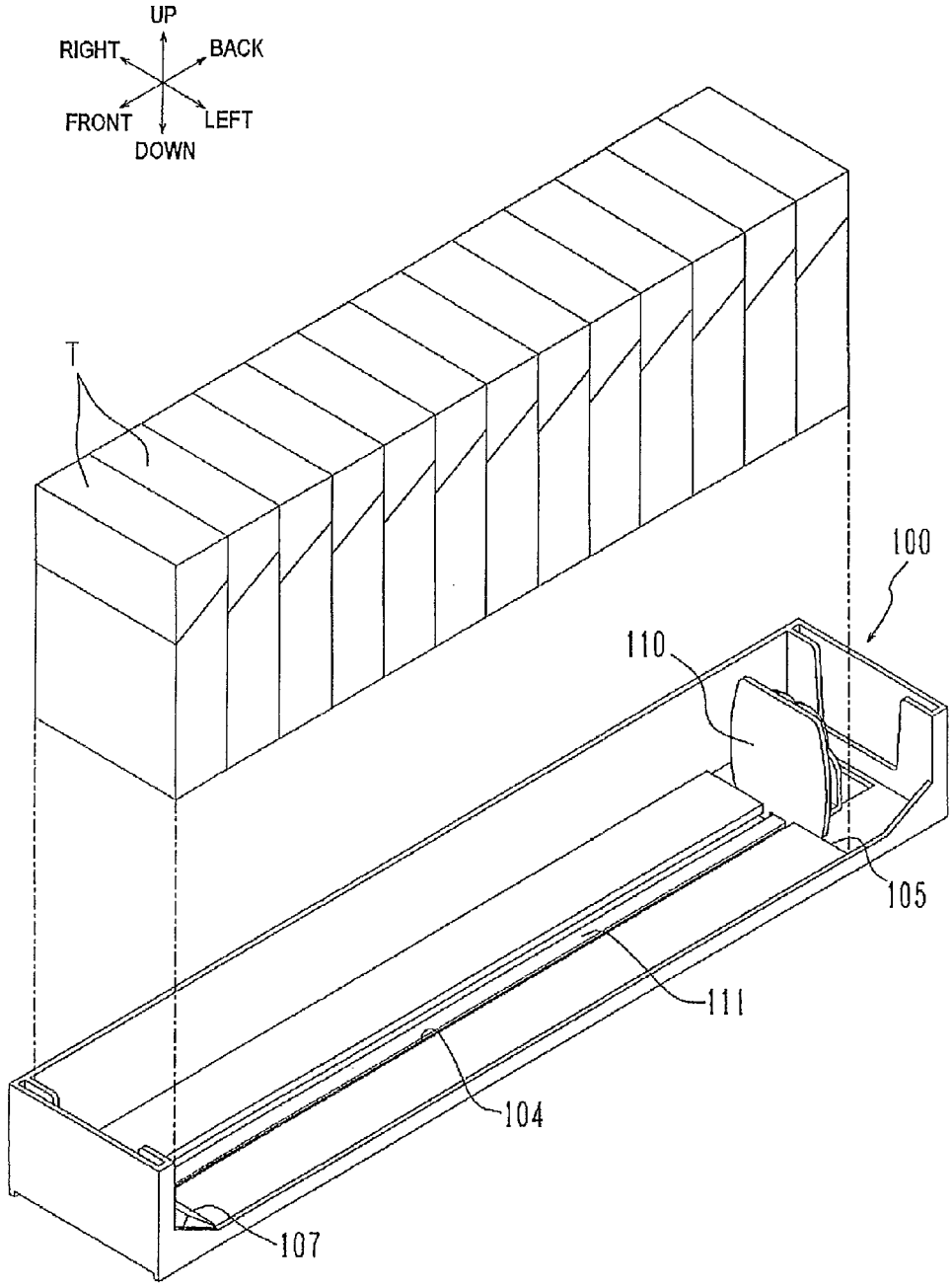
FIG. 3 is an exploded perspective view showing a condition in which cigarette packs are being accommodated in a magazine unit.
Figure 4:
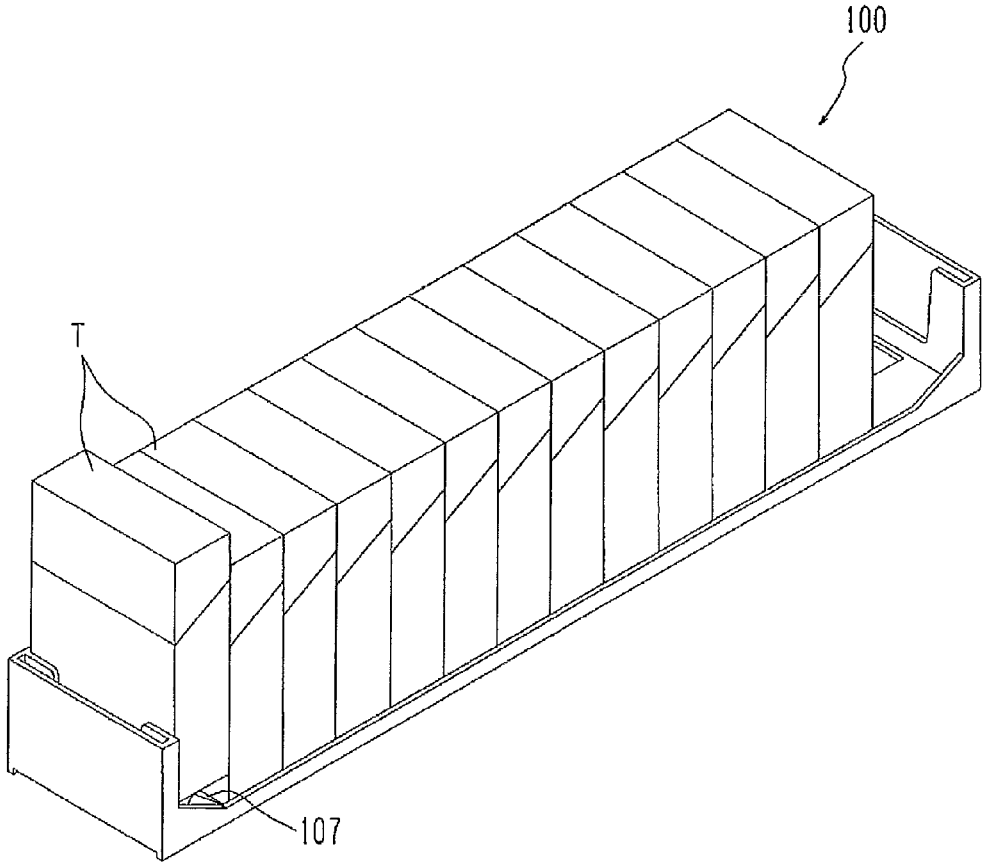
FIG. 4 is a perspective view showing a condition in which cigarette packs have been accommodated in the magazine unit.
Figure 5:
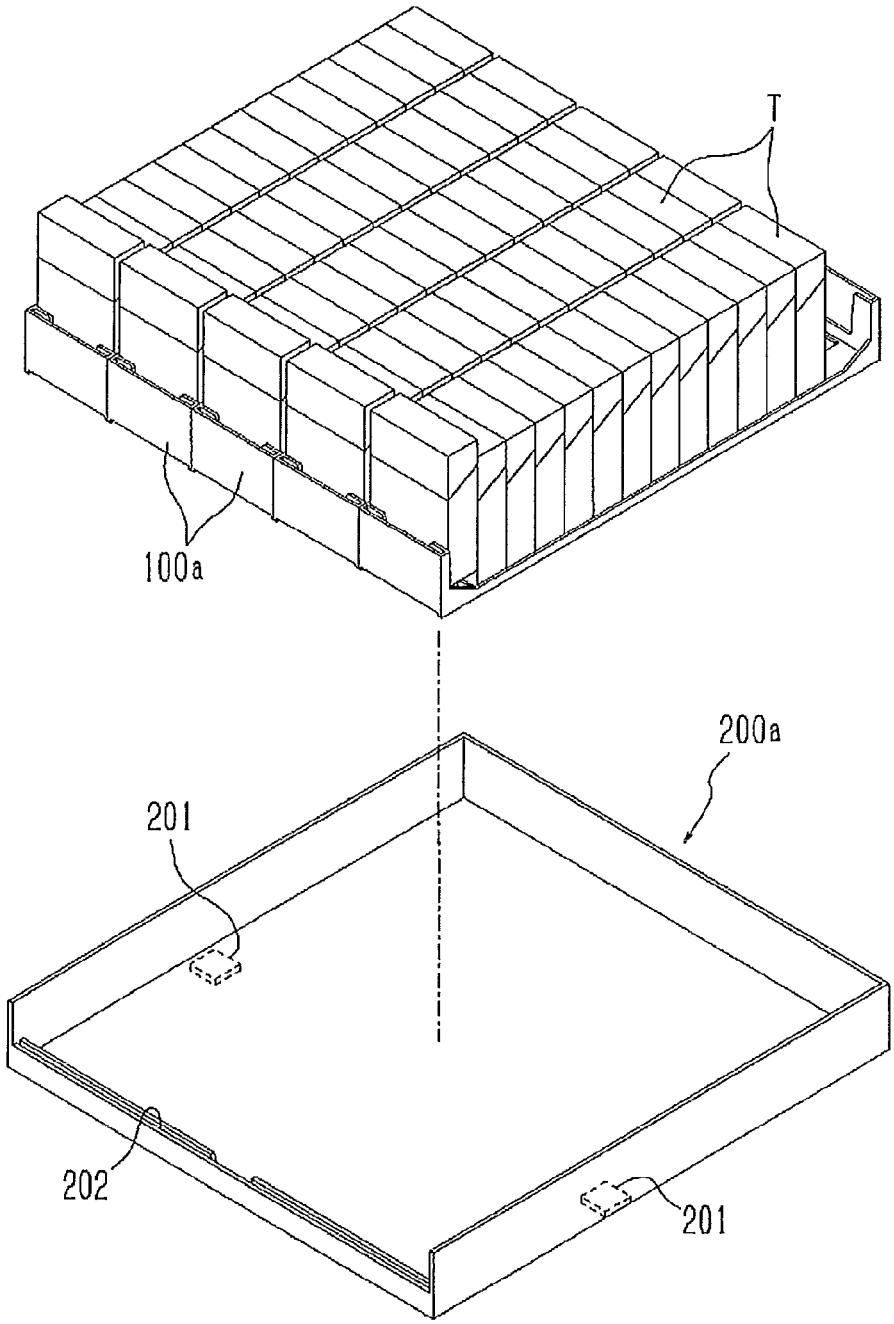
FIG. 5 is an exploded perspective view showing a condition in which the magazine units where the cigarette packs are accommodated are being set into one of four types of tray units.
Figure 6:
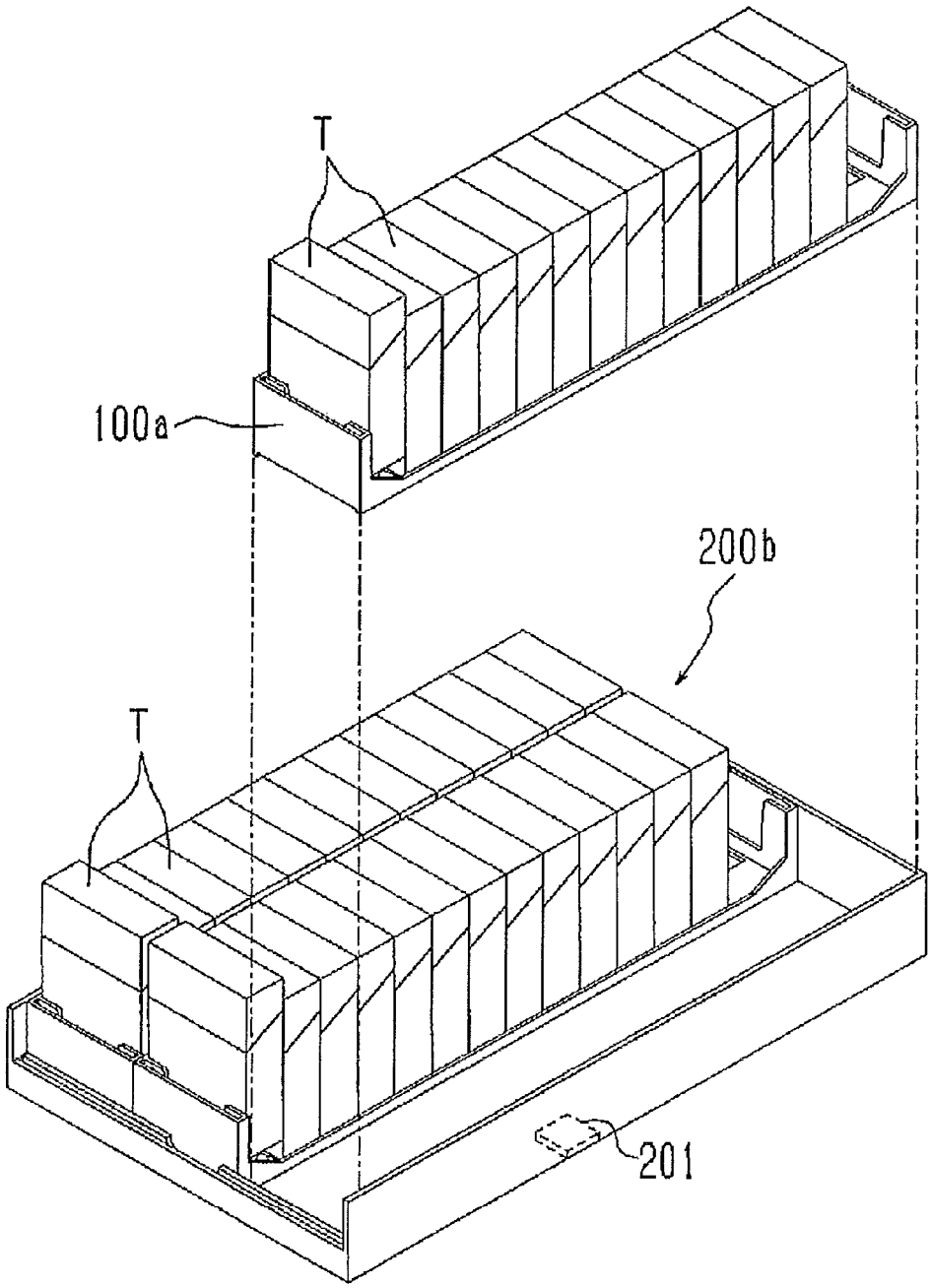
FIG. 6 is an exploded perspective view showing a condition in which the magazine units where the cigarette packs are accommodated are being set into one of four types of tray units.
Figure 7:
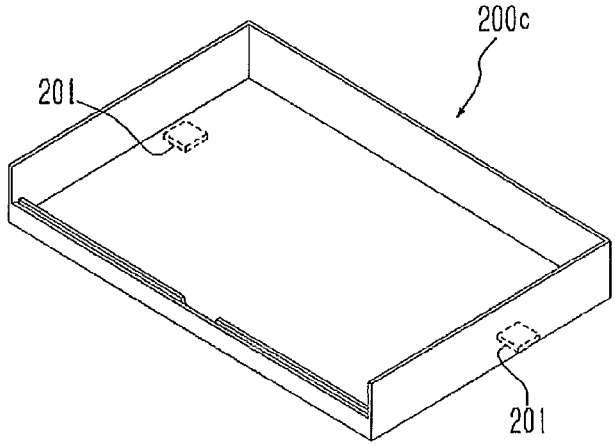
FIG. 7 is a perspective view showing one of the four types of tray units.
Figure 8:
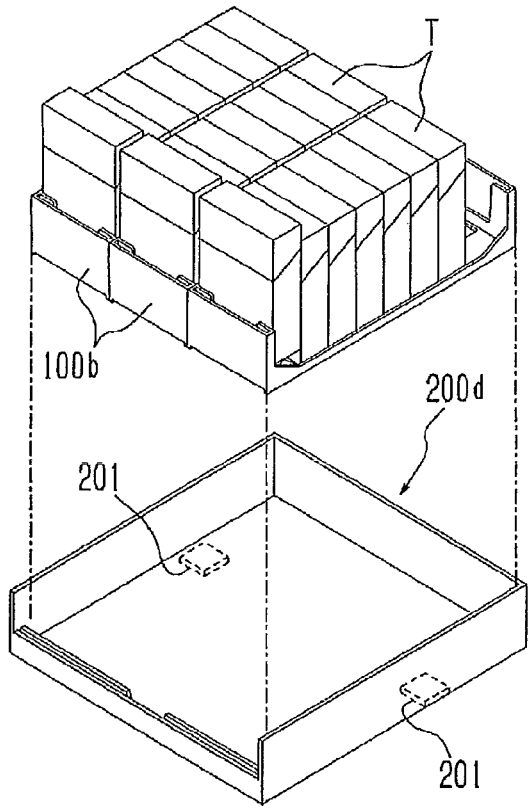
FIG. 8 is an exploded perspective view showing a condition in which the magazine units where the cigarette packs are accommodated are being set into one of four types of tray units.

Generally, a brand name and the like are printed on the front surface (and the back surface) of the cigarette pack T. Therefore, the cigarette packs T are preferably displayed in a suitable condition in direction so that the front faces are located at front. As shown in FIGS. 2 to 4, the magazine unit 100 accommodates the cigarette packs T, which are facing in the appropriate direction as mentioned above and arranged in a direction from front to back.

Here, as shown in FIG. 2, the cigarette display system 1000 of the embodiment includes: a magazine unit 100*a*, which has a long length from front to back to hold thirteen cigarette packs T; and a magazine unit 100*b*, which has a short length from front to back to hold seven cigarette packs T.

The magazine unit 100 is formed by a colorless, transparent resin. Pockets 101, 102 having an opened top are formed at front end and back end of the magazine unit 100.

For example, a price tag of a cigarette pack T which is shown to customers is accommodated in the front pocket 101. For example, an information card of a cigarette pack T for a store clerk to check is accommodated in the back pocket 102.

An opening 104 elongated in a direction from front to back is formed at the bottom of the magazine unit 100, and a slider member 110 is attached to the opening 104 so as to be slidable in a direction from front to back.

As shown in FIG. 3, as for the slider member 110, a wound plate spring 111 is attached to a rear of the slider member 110 as an urging mechanism. One end of the plate spring 111 is pulled out from the bottom of the slider member 110 and attached to a front part of the magazine unit 100.

Accordingly, the slider member 110 is resiliently urged toward the front by the plate spring 111. As shown in FIG. 3, since the plate spring 111 pulled out from the slider member 110 is located inside the opening 104 of the magazine unit 100, the plate spring 111 does not come into contact with a bottom surface of the cigarette packs T accommodated in the magazine unit 100.

A stopper step 105 is formed at a rear bottom of the magazine unit 100. While being engaged with the stopper step 105, the slider member 110 stops against tension of the plate spring 111.

Further, a magazine protrusion 107 having a triangle shape of cross-section orthogonal to the lateral direction is formed at a front bottom of the magazine unit 100. The magazine protrusion 107 is formed to have a length from front to back same as that of a single cigarette pack T.

Accordingly, as shown in FIG. 4, among the plurality of cigarette packs T, which are accommodated in the magazine unit 100 and pushed by the slider member 110 toward the front, only one at the front end protrudes upward.

Although the magazine protrusion 107 is formed at front bottom of the magazine unit 100 as mentioned above, in the backward range from the protrusion 107 where the slider member 110 can make sliding movement, the bottom surface is made in a flat plane without a protrusion.

As shown in FIGS. 5 to 8, the tray unit 200 is also formed in the shape of a box having an opened top using a colorless, transparent resin. A plurality of magazine units 100 is accommodated in the tray unit 200 while the magazine units 100 are arranged in a lateral direction. There are two types of magazine units 100*a* and 100*b* which have different lengths from front to back, as mentioned above.

Here, the cigarette display system 1000 of the present embodiment includes a tray unit 200*a* which accommodates five magazine units 100*a* having a long length from front to back, a tray unit 200*b* which accommodates three magazine units 100*a* having a long length from front to back, a tray unit 200*c* which accommodates five magazine units 100*b* having a short length from front to back, and a tray unit 200*d* which accommodates three magazine units 100*b* having a short length from front to back.

Tray protrusions 201 are formed at both sides of the bottom surface of the tray unit 200. Although, there are four types of tray units 200 of combinations of two types of width and two types of lengths from front to back, as mentioned above, the length between the tray protrusion 201 and the front surface is common to all types of tray units. A pocket 202 which accommodates, for example, an advertisement card for a plurality of cigarette packs T is formed at a front part of the tray unit 200.

Figure 9:
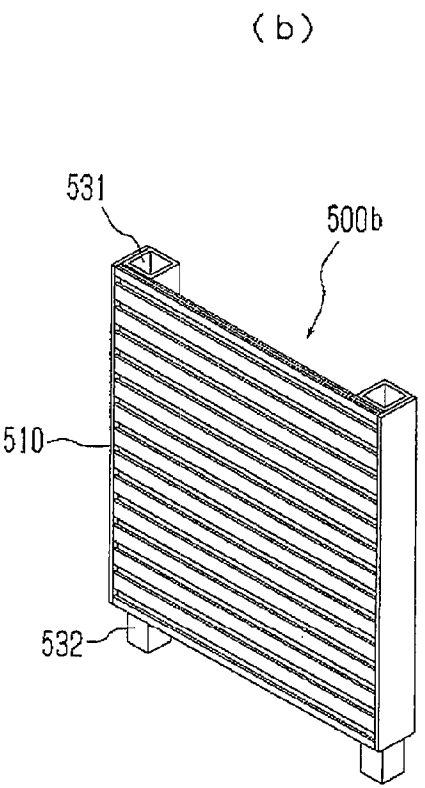
FIG. 9 is a perspective view showing appearances of two types of wall units.
Figure 9:
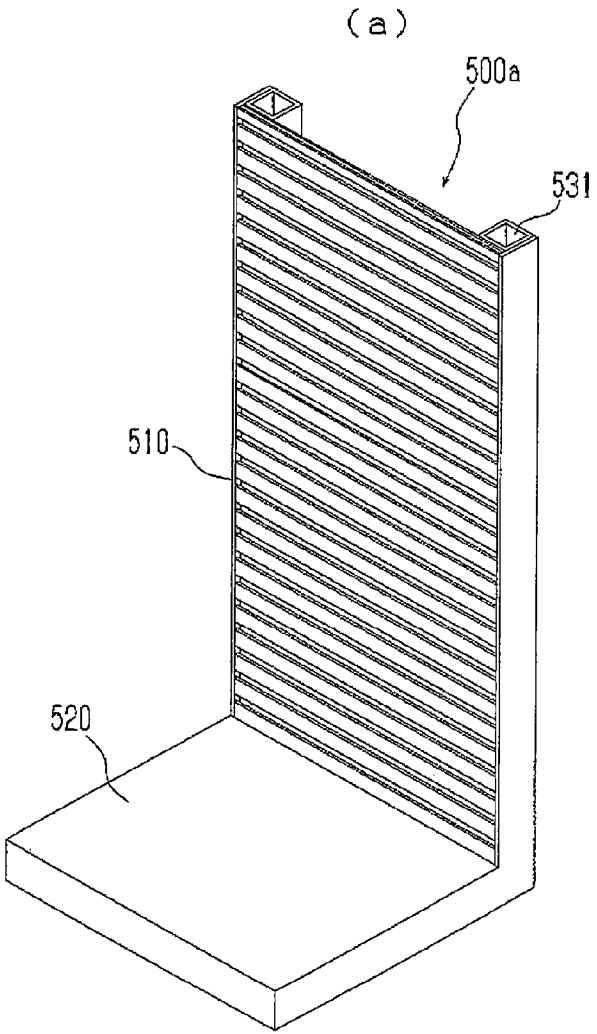

As shown in FIG. 9, the wall units 500 include a base wall 500*a* and a panel wall 500*b*. Each of the base wall 500*a* and the panel wall 500*b* has a wall part 510 which has a flat plate shape flattened in a direction from front to back.

In the base wall 500*a*, a pedestal 520 is integrally formed at a bottom end of the wall part 510, and a wall link mechanism is mounted at the top end of the wall part 510. In the panel wall 500*b*, the wall link mechanisms are mounted at the top end and the bottom end.

More specifically, in the wall unit 500, metal pipes 531 that are rectangular in cross-section and have additional function of reinforcement are attached at left and right of the back surface. In the panel wall 500*b*, metal pipes 532 having a diameter slightly smaller than that of the metal pipes 531 are fixed at the bottom end of the metal pipes 531.

The metal pipes 532 at the bottom end of the panel wall 500*b* engage with the metal pipes 531 at the top end of the base wall 500*a* and the panel wall 500*b* from the top in such a manner that the metal pipes 532 can be freely engaged and disengaged. By using the wall link mechanism including these metal pipes 531, 532, it is possible to link a plurality of panel walls 500*b* in the vertical direction and also link the panel wall 500*b* to the base wall 500*a* on the top thereof.

Figure 10:
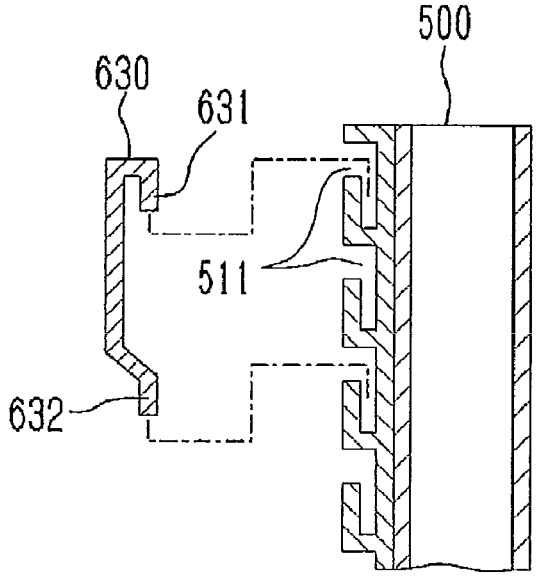
FIG. 10 is a perspective view showing appearances of two types of wall units.
Figure 10:
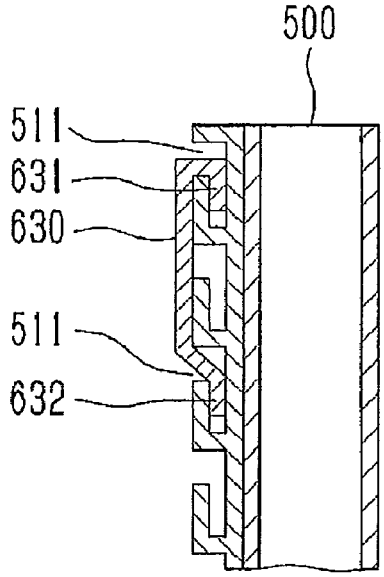

Recesses and protrusions of a predetermined shape are formed on the front surface of the wall part 510 of the base wall 500*a* and the panel wall 500*b*. More specifically, as recesses and protrusions, concavity channels 511 running in the lateral direction are arranged at a predetermined interval in the vertical direction. As shown in FIG. 10, the concavity channel 511 is formed in a cross-section of L shape whose rear part is bent downward, for example.

Figure 11:
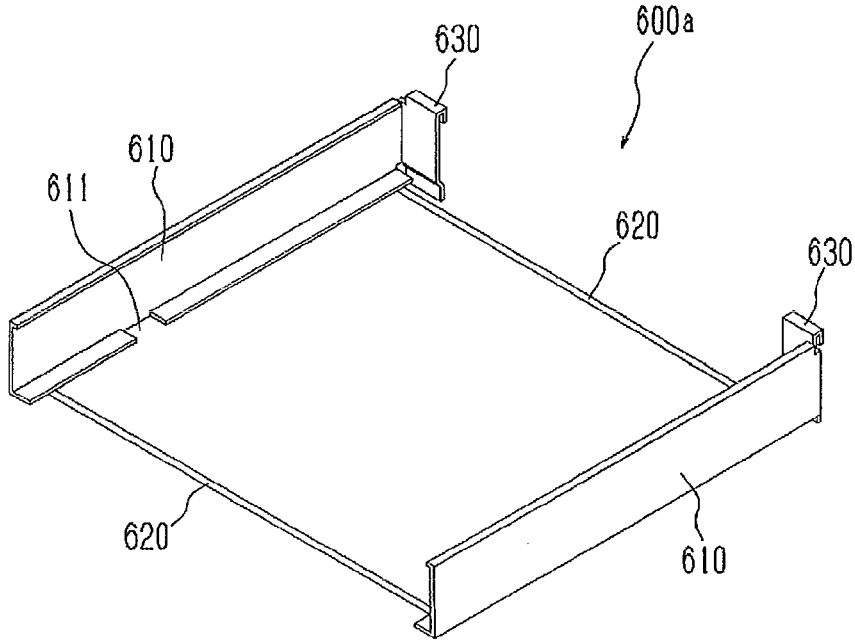
FIG. 11 is a perspective view showing two appearances of four types of tray attachments.
Figure 11:
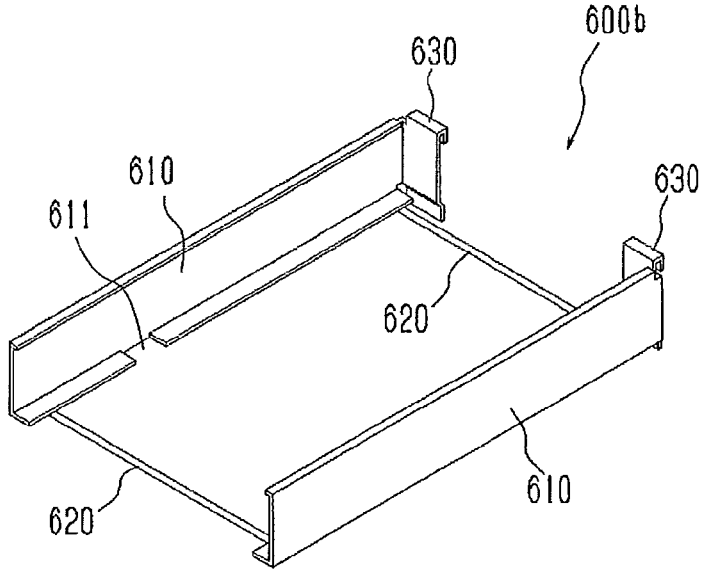
Figure 12:
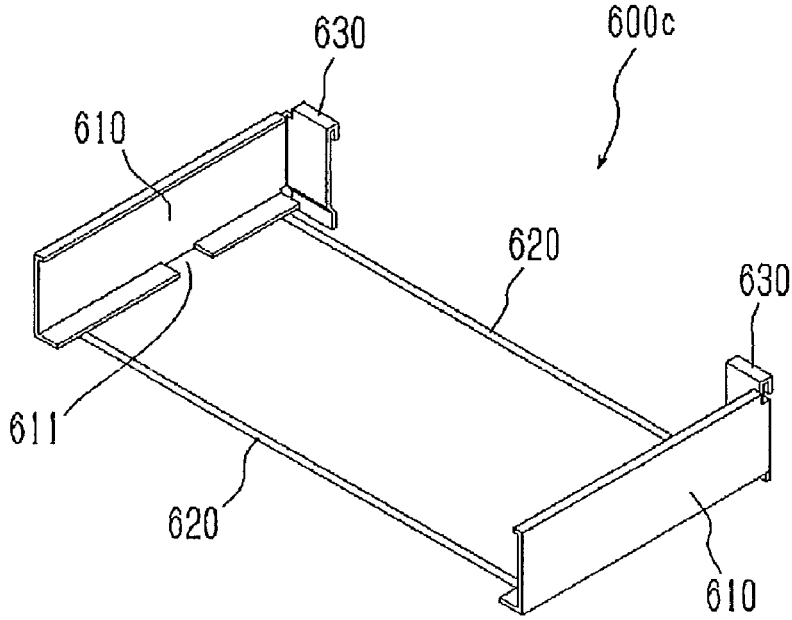
FIG. 12 is a perspective view showing two appearances of four types of tray attachments.
Figure 12:
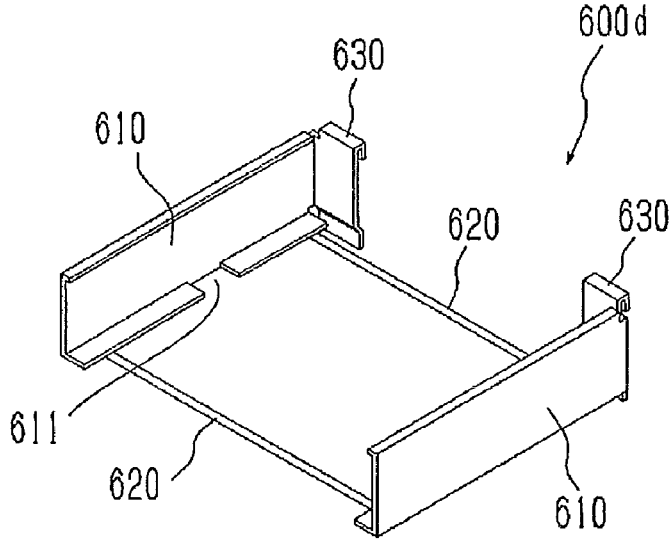

As shown in FIGS. 11 and 12, tray attachments 600*a* to 600*d* are formed in a structure capable of holding the tray units 200*a* to 200*d* respectively. More specifically, the tray attachment 600 has a pair of support frames 610 elongated in a direction from front to back.

The support frame 610 is made of a metal plate which is formed in a rail shape elongated in a direction from front to back for supporting the tray unit 200. The pair of support frames 610 is linked by link frames 620 elongated in the lateral direction at the front and back of the bottom surface.

Here, as mentioned above, there are four types of tray units 200 of combinations of two types of lateral widths and two types of lengths from front to back. Accordingly, there are four types of tray attachments 600*a* to 600*d* of combinations of two types of lateral widths and two types of lengths from front to back, corresponding to the tray units 200*a* to 200*d*.

Further, a guide concave part 611 is formed in the support frame 610 in the tray attachments 600*a* to 600*d*. The tray protrusion 201 of the tray unit engages with the guide concave part 611.

In the four types of tray units 200 and the four types of tray attachments 600, the tray protrusions 201 and the guide concave parts 611 are formed so that the positions of back parts of the tray unit 200 and the tray attachment 600 are lined up in well-positioned when the tray unit 200 is attached to the tray attachment 600.

Further, the engagement mechanism 630 which detachably engages with the concavity channel 511 of the wall unit 500 is formed at the back end of the support frame 610. As shown in FIG. 10, this engagement mechanism 630 includes a pair of upper and lower L-shaped engagement parts 631, 632 for engaging with the concavity channels 511 of the wall unit 500.

Figure 13:
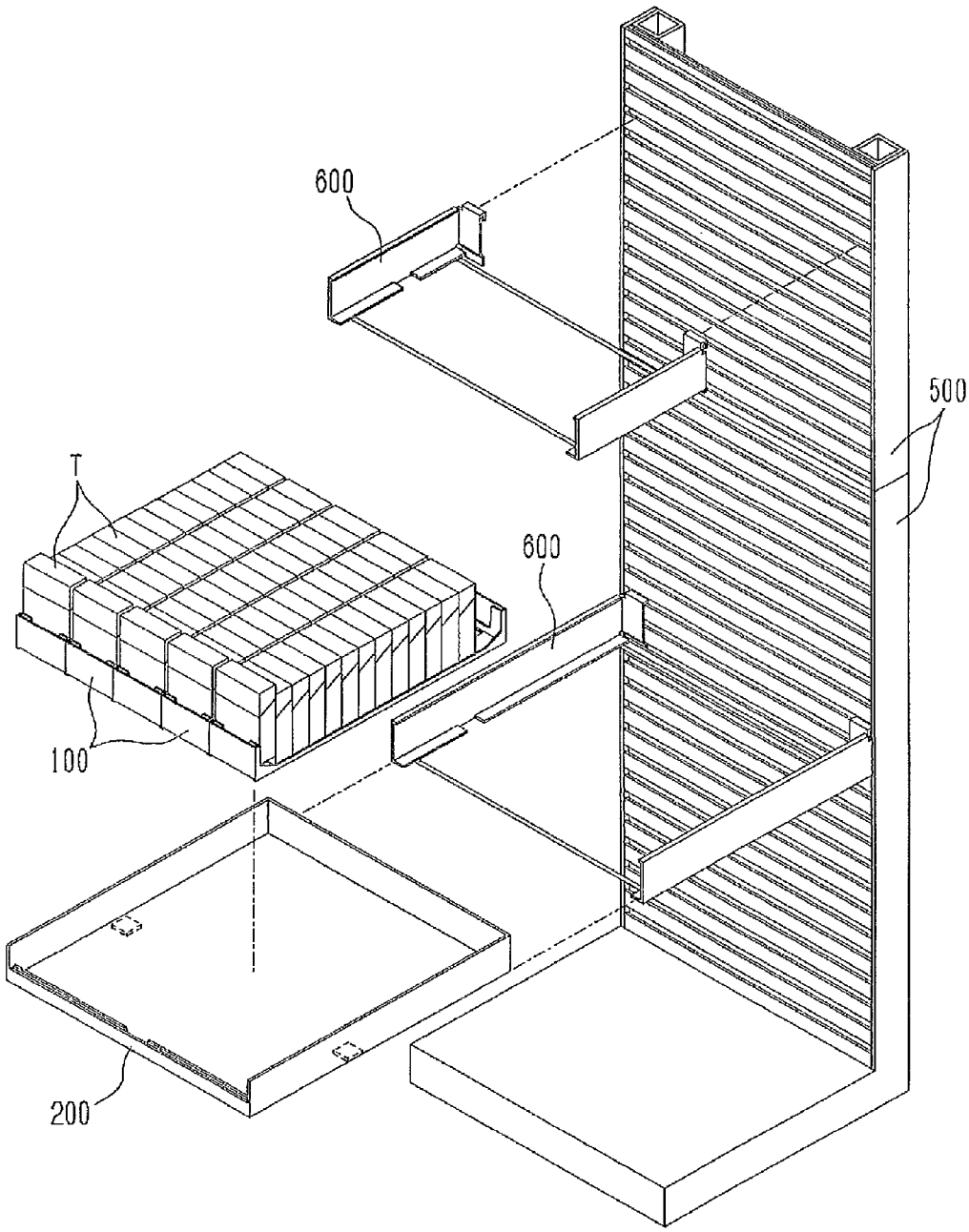
FIG. 13 is an exploded perspective view showing a condition in which a tray unit is being attached to a wall unit by a tray attachment.

As mentioned above, there are two types of lateral widths in the tray units 200 and the tray attachments 600. Therefore, as shown in FIG. 13, the wall unit 500 is formed to have a lateral width which corresponds to the wide tray attachments 600*a* and 600*c*.

As mentioned above, since there are two types of lengths from front to back in the tray unit 200, the pedestal 520 of the base wall 500*a* is formed to have a length from front to back corresponding to that of the tray units 200*a* and 200*b* which have the longest length from front to back. Therefore, the tray unit 200 does not protrude forward beyond the pedestal 520 of the base wall 500*a*, regardless of the type of the used tray unit 200.

As shown in FIG. 1 and other drawings, the cigarette display system 1000 of the embodiment may have various types of units which are detachably attached to the wall units 500, other than the tray units 200 mentioned above.

Figure 14:
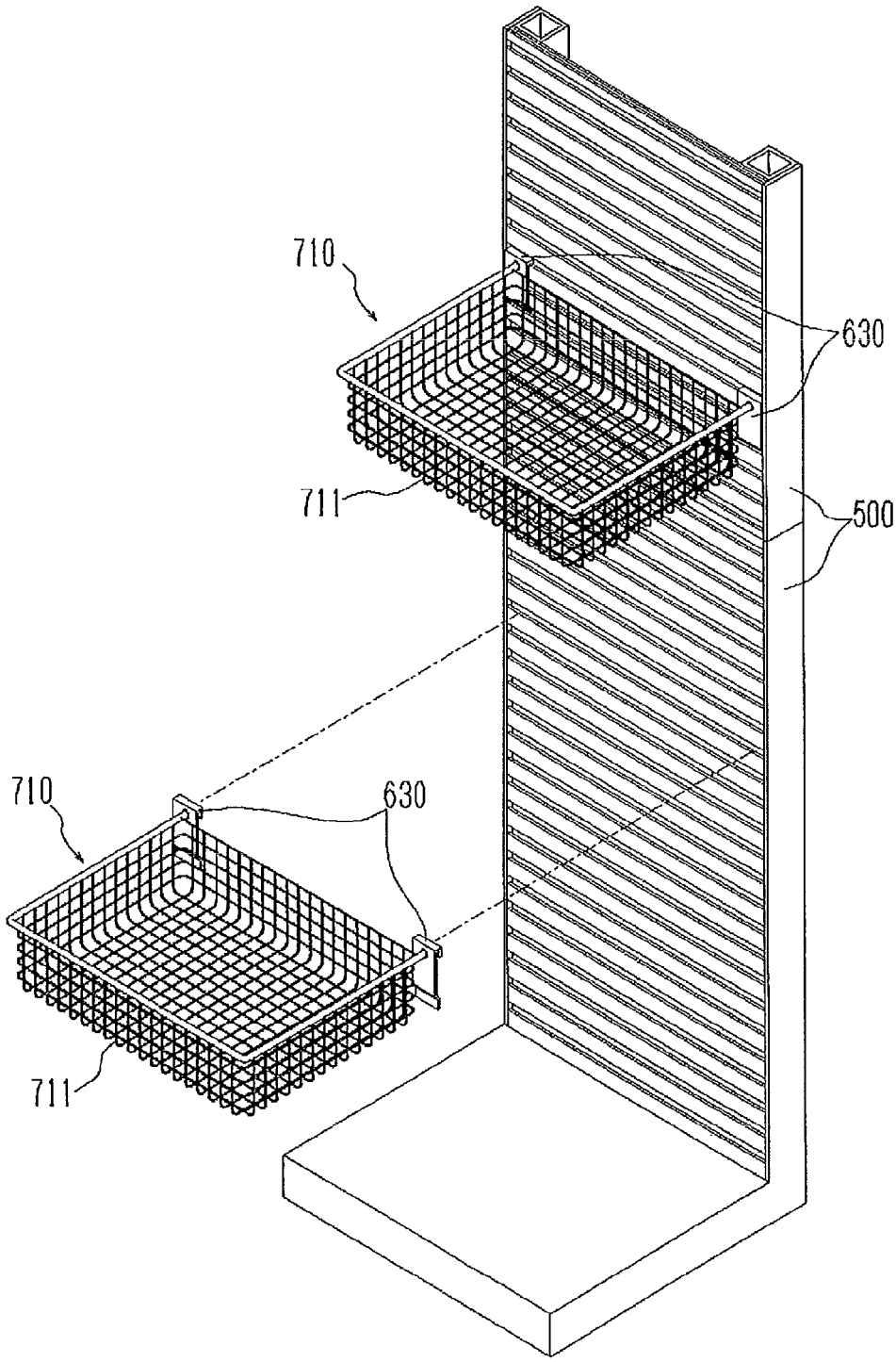
FIG. 14 is an exploded perspective view showing a condition in which a basket unit is being attached to a wall unit.

For example, as shown in FIGS. 1 and 14, a basket unit 710 includes a basket member 711 formed in the shape of a box with an opened top, and the engagement mechanism 630 formed at a rear part of the basket member 711.

Figure 15:
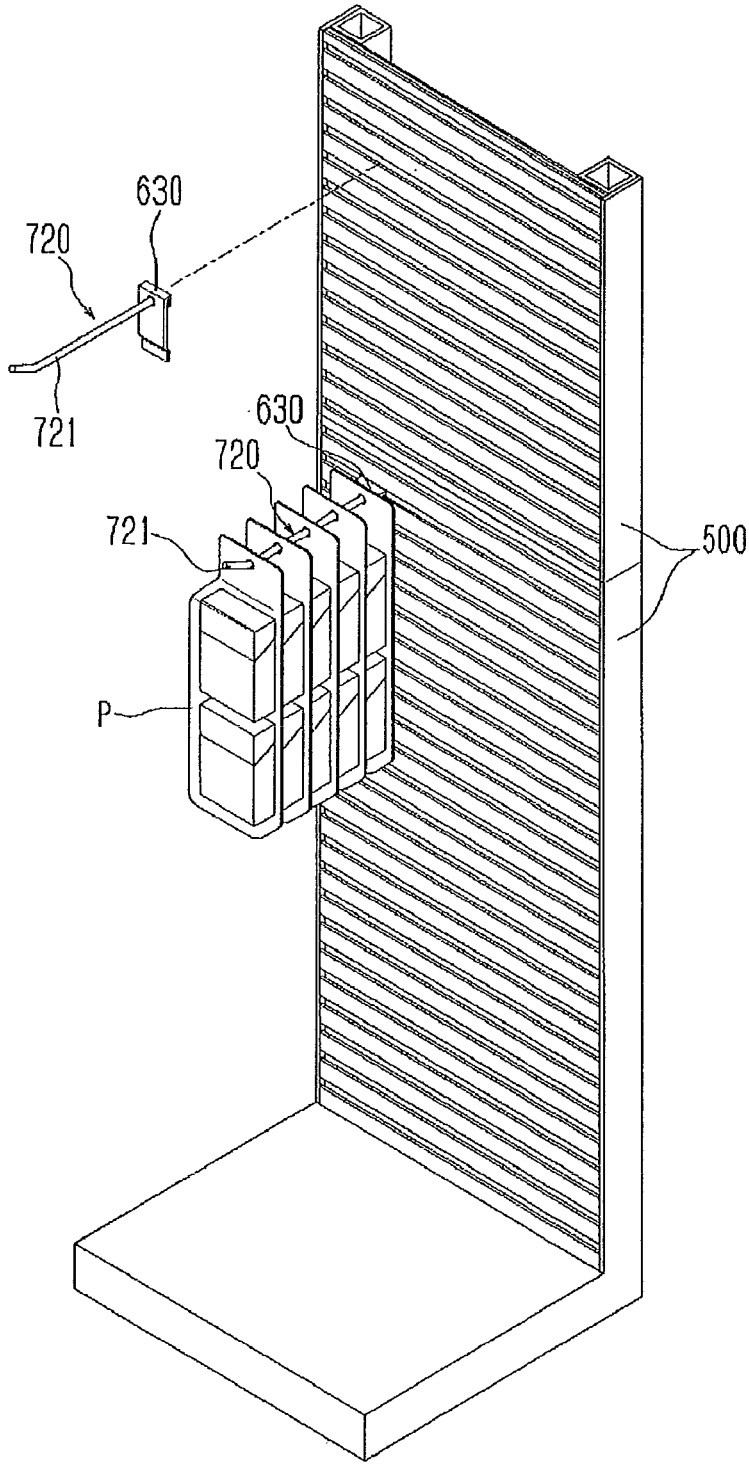
FIG. 15 is an exploded perspective view showing a condition in which a shaft unit is being attached to a wall unit.

Further, as shown in FIGS. 1 and 15, a shaft unit 720 includes a shaft member 721 elongated in a direction from front to back and the engagement mechanism 630 formed at a rear part of the shaft member 721.

Figure 16:
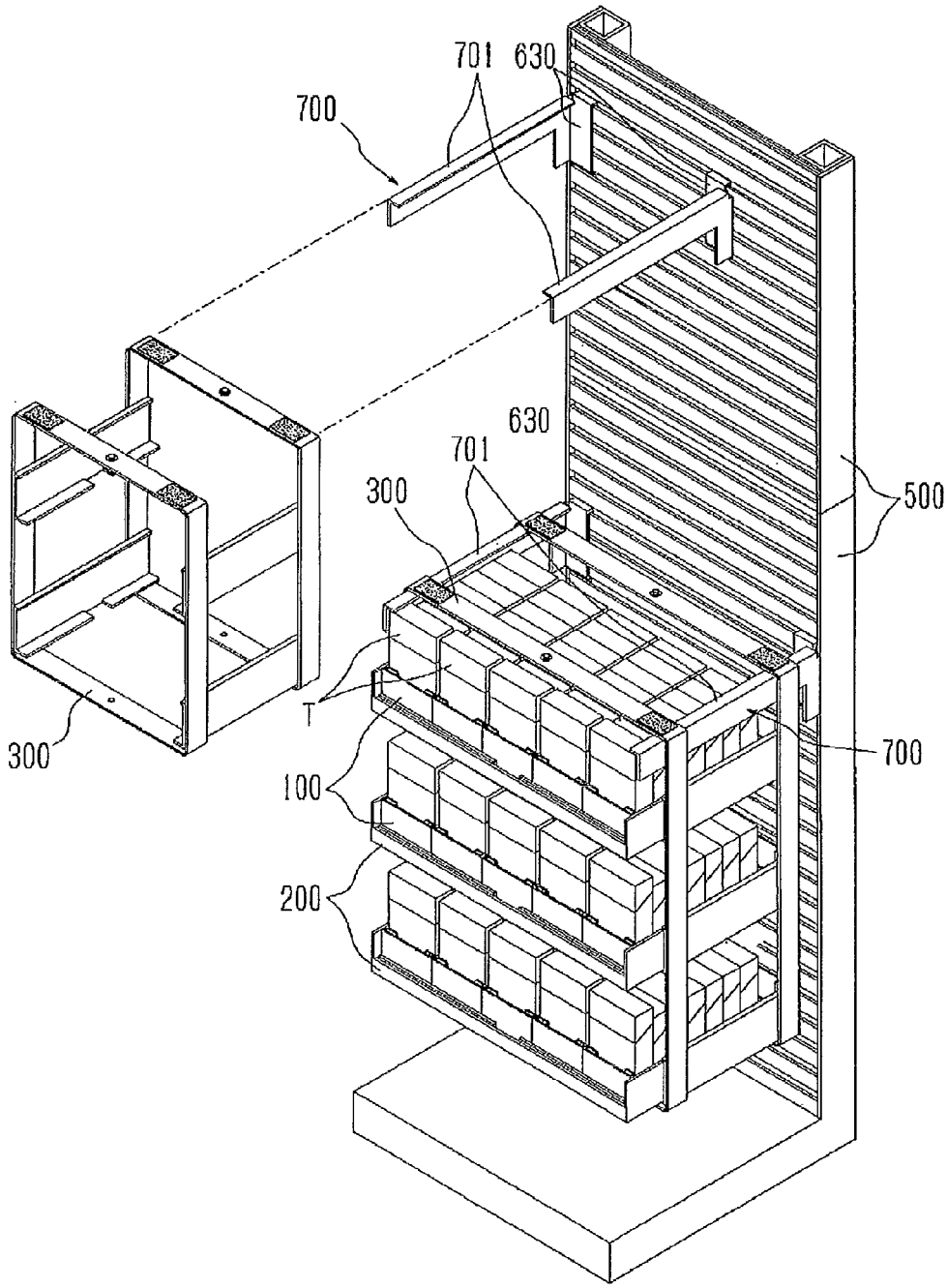
FIG. 16 is an exploded perspective view showing a condition in which a frame unit is being attached to a wall unit by a frame attachment.
Figure 17:
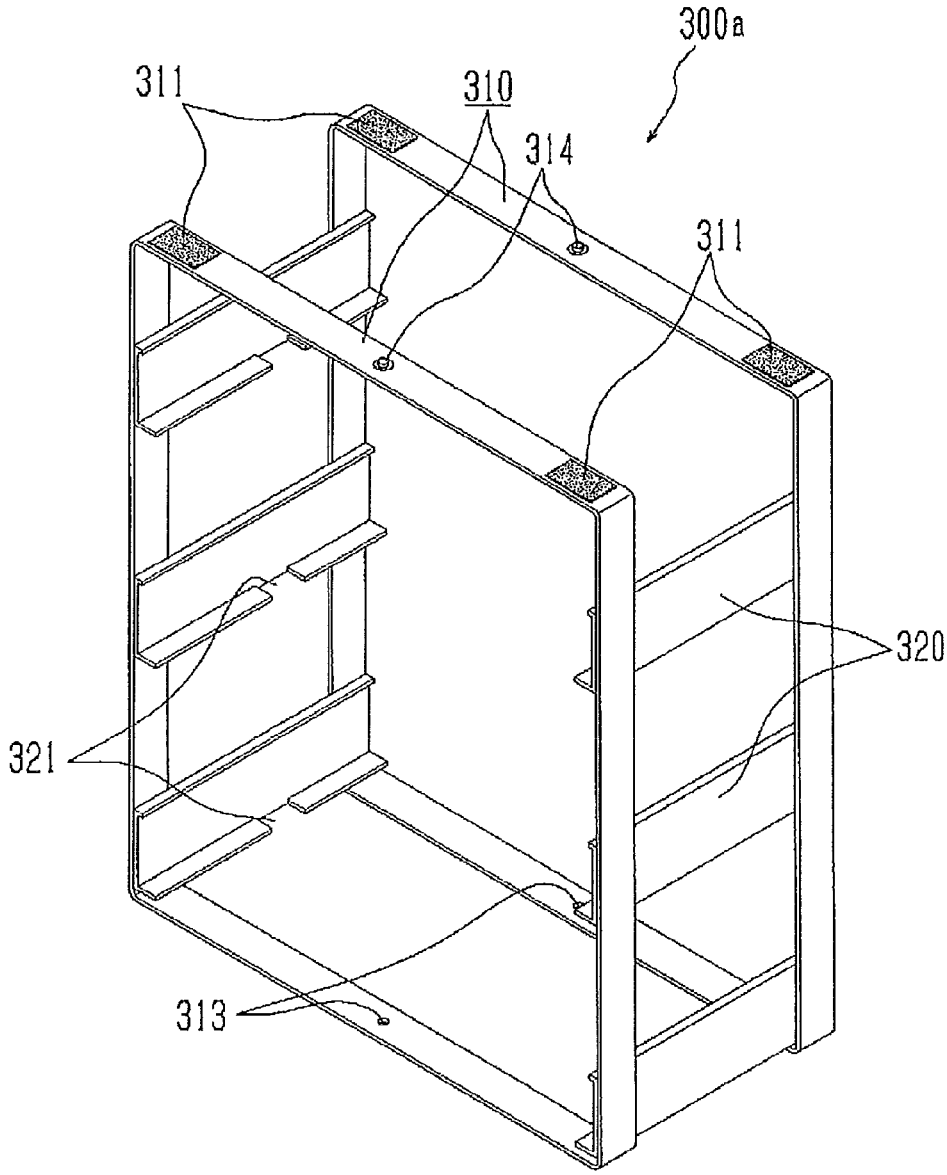
FIG. 17 is a perspective view showing one of four types of frame units.
Figure 18:
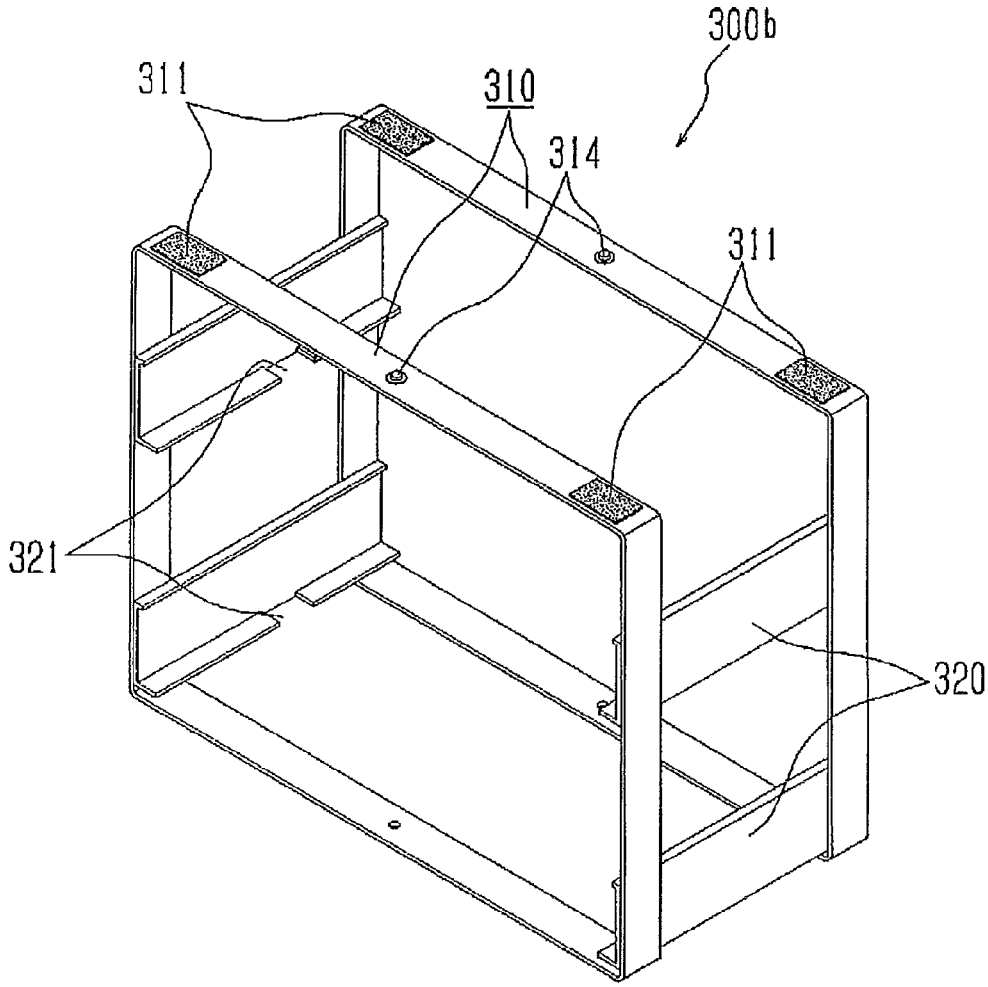
FIG. 18 is a perspective view showing one of the four types of frame units.
Figure 19:
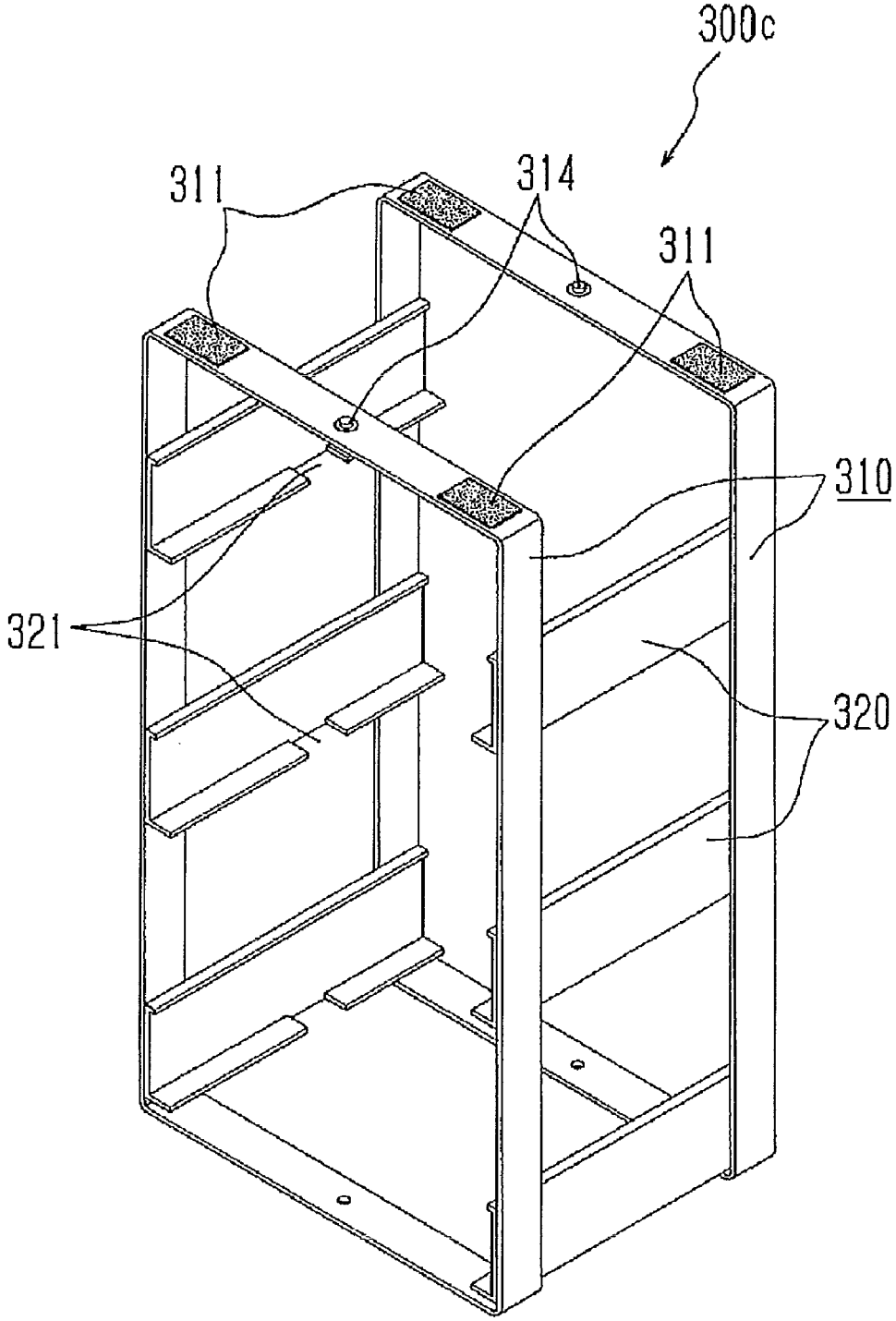
FIG. 19 is a perspective view showing one of the four types of frame units.
Figure 20:
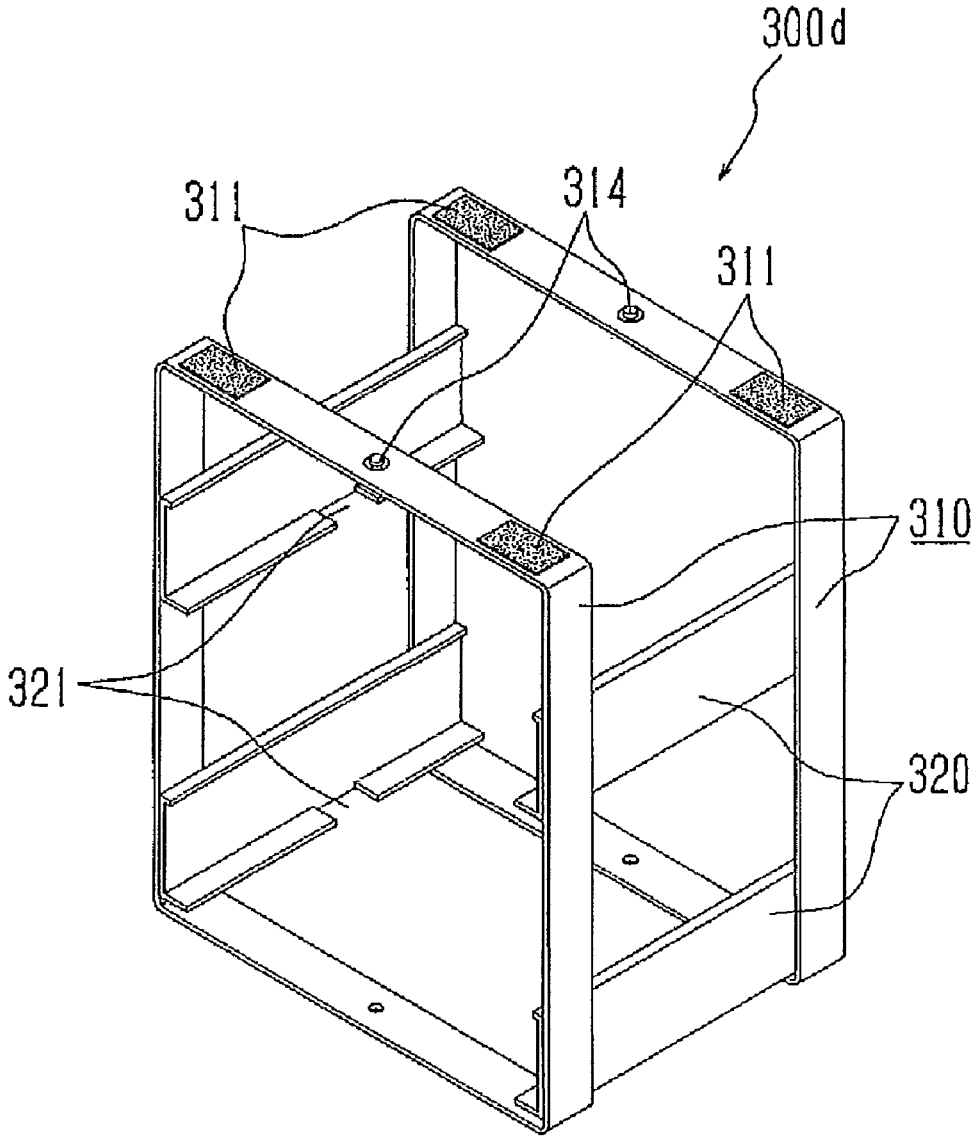
FIG. 20 is a perspective view showing one of the four types of frame units.

Further, as shown in FIGS. 1 and 16, the frame unit 300 is attached to the front surface of the wall unit 500 by a pair of frame attachments 700. The frame attachment 700 includes a support part 701 which is elongated in a direction from front to back and has a cross-section of L shape, and the engagement mechanism 630 formed at a rear part of the support part 701.

The frame unit 300 is formed in the shape of a box having an opened front, and detachably holds a plurality of tray units 200 in an arrangement in which the tray units are separated apart in the vertical direction. More specifically, as shown in FIGS. 17 to 20, the frame unit 300 includes a pair of main frames 310 and a plurality of support frames 320.

The main frame 310 is made of a metal plate which is bent so that a front shape becomes rectangular. A pair of the main frames 310 is arranged in a direction from front to back. The support frame 320 is made of a metal plate which is formed in a rail shape elongated in a direction from front to back for supporting the tray unit 200, and a plurality of support frames 320 are arranged in the vertical direction and joined to an inner surface of the pair of the main frame 310.

Also in the frame unit 300, a guide concave part 321 with which the tray protrusion 201 of the tray unit 200 engages is formed in the support frame 320. As mentioned above, there are two types of lateral widths in the tray units 200.

Therefore, as shown in FIGS. 17 to 20 and other drawings, the cigarette display system 1000 of the present embodiment includes, a frame unit 300*a* for holding three of the tray units 200*a*, 200*c* having a large lateral width, a frame unit 300*b* for holding two of the tray units 200*a*, 200*c* having the large lateral width, a frame unit 300*c* for holding three of the tray units 200*b*, 200*d* having a small lateral width, and a frame unit 300*d* for holding two of the tray units 200*b*, 200*d* having the small lateral width.

In the configuration as mentioned above, in the cigarette display system 1000 of the embodiment, as shown in FIG. 1, a plurality of wall units 500 can be linked in the vertical direction to obtain a desired height. The wall units 500 can be arranged in the lateral direction to obtain a desired lateral width.

As a result, the entire height and the entire width of the cigarette display system 1000 of the embodiment can be increased or decreased as desired. Therefore, it is possible to adapt an outer shape to an installation space. Accordingly, it is possible to use space effectively, and favorably suppress generation of dead space.

It is also possible to attach the tray unit 200 on a desired position of the front surface of the wall units 500 arranged in the vertical and lateral directions as mentioned above, by using the tray attachment 600. In addition, it is possible to attach the tray unit 200 on a desired position of the front surface of the assembled wall units 500, by using a pair of frame attachments 700 and the frame unit 300.

The cigarette packs T can be accommodated in the tray unit 200 attached to the front surface of the wall units 500 as mentioned above, by using the magazine units 100. In that case, a user can freely make a combination of the four types of tray units 200*a* to 200*d*, and the two types of magazine units 100*a* and 100*b*, as desired. Accordingly, the cigarette packs T can be displayed in a free layout.

In addition, since the cigarette cartons K and the simple fittings F can be directly accommodated in the tray unit 200 and the frame unit 300, it is possible to favorably display the cigarette cartons K or the like which are difficult to be displayed in a conventional cigarette display system.

In particular, a lateral width of the tray units 200*a*, 200*c* which hold five magazine units 100 is slightly longer than the total length of the cigarette carton K. Therefore, the cigarette cartons K can be accommodated in the tray units 200*a*, 200*c* without there being any lengthwise surplus space while the longest sides of the cigarette cartons K placed in the lateral direction.

Furthermore, the basket unit 710 can be attached to a desired position of the front surface of the wall units 500. Accordingly, by using the basket unit 710, it is possible to favorably display the cigarette cartons K, the simple fittings F, and the like which are difficult to be displayed in a conventional cigarette display system.

In addition, the shaft unit 720 can be attached to a desired position of the front surface of the wall units 500. Accordingly, by using the shaft unit 720, it is possible to favorably display campaign packs P or the like which are difficult to be displayed in a conventional cigarette display system.

In the cigarette display system 1000 of the embodiment, it is possible to freely change the entire height and entire width of the wall units 500, and freely display not only the cigarette packs T, but also the cigarette cartons K, the simple fittings F, the campaign packs P, and the like on the front surface of the wall units 500, as mentioned above.

Accordingly, an owner or the like of a store selling the cigarette packs T can freely change the display configuration. Therefore, since an installation area and a display configuration of the cigarette packs T are flexible, it is possible to set up a sales space which can attract attention effectively.

The owner or the like of the store can actively design a cigarette pack display configuration to set up a sales space which can attract attention effectively. Furthermore, companies which provide the cigarette packs T to stores can propose new display configurations.

In addition, the wall units 500 function as a partition. Therefore, it is possible to favorably display the cigarette packs T to customers while favorably separating the positions of customers and store clerks, for example.

Further, when the cigarette display system 1000 is placed along a wall surface of the store, the wall surface can be shielded by the wall units 500. In this case, the wall units 500 is shown through the gaps between the displayed cigarette packs T and the wall surface of the store is not shown through gaps, and thus, it is possible to display the cigarette packs in a more appealing manner.

In addition, the wall units 500 are joined together in the vertical direction by engagements of the metal pipes 531 and 532. Accordingly, a plurality of wall units 500 can be joined together easily and securely in the vertical direction without any tools or the like.

Because of this, the cigarette display system 1000 which is large and strong as a whole can be easily set up by using small and lightweight wall units 500. Especially, since the cigarette packs T to be accommodated are lightweight, the cigarette display system 1000 relatively has high strength.

Especially, the above-mentioned metal pipes 531, 532 combine with the reinforcement of the wall unit 500. Accordingly, the wall unit 500 therefore requires only a minimum number of parts, is lightweight and can be made easily.

The cigarette display system 1000 of the embodiment can be brought in while disassembled into each part, and can be assembled without using tools. Therefore, bringing in and installation of the cigarette display system can be performed quickly while using a small space.

For example, for a 24-hour convenience store, bringing in and installation of the cigarette display system 1000 need to be performed when a store is open to customers. However, as mentioned above, the cigarette display system 1000 can be quickly brought in and installed using a small space. Therefore, it does not disturb a sales operation of the convenience store and the like.

Further, the magazine unit 100 pushes forward a plurality of accommodated cigarette packs T by the slider member 110. Because of this, the cigarette packs T accommodated in a plurality of magazine units 100 can be automatically displayed in a common position.

In addition, the magazine unit 100 pushes up only one at the front end of the cigarette packs T accommodated by the magazine protrusion 107. Accordingly, it is easy to pick up a single cigarette pack from the accommodated plurality of cigarette packs T.

Therefore, by installing the cigarette display system 1000 in a sales space facing customers, it is possible that a customer picks up a desired cigarette pack T or the like, while the cigarette packs T or the like are favorably displayed to customers.

In the magazine unit 100, as shown in FIG. 3, by engaging the slider member 110, which is placed backward by sliding movement, with the stopper step 105, the slider member 110 can be stopped against the tension of the plate spring 111. Accordingly, it is easy to replenish a plurality of cigarette packs T in the magazine unit 100.

Since the cigarette display system 1000 of the embodiment can be assembled by a freely combining the wall units 500, the tray units 200, and magazine units 100 as mentioned above, it is easy to disassemble a part of the cigarette display system 1000 and clean it.

Especially, the magazine unit 100 of the embodiment has a flat bottom surface having no protrusion, at least in a range where sliding movement is allowed for the slider member 110. Accordingly, the bottom surface of the magazine unit 100, on which the cigarette packs T are directly placed and which is easy to be dirty, can be easily washed or cleaned.

Further, the magazine units 100 and the tray units 200 are formed by a colorless, transparent resin. Accordingly, it is possible to display the cigarette cartons K accommodated in the tray units 200 and the cigarette packs T accommodated in the tray units 200 by using the magazine units 100, in a condition in which they are favorably seen.

At present, the cigarette packs T and the cigarette cartons K are packed in a cardboard box and provided to a store, and they are replenished into the magazine units 100 or the tray units 200 of the cigarette display system 1000 in the store.

However, it is also possible to provide the magazine units 100 filled with the cigarette packs T and the tray units 200 filled with the cigarette cartons K to a store, and collect empty magazine units 100 and empty tray units 200 from the store. In this case, since the operation to replenish the cigarette packs T and the cigarette cartons K into the magazine units 100 and the tray units 200 is not needed in the store, it is possible to increase sales efficiency.

The present invention is not limited to the embodiment, and various modifications are allowed without departing from the scope of the invention. For example, in the above embodiment, it is exemplified that the cigarette display system 1000 includes the wall units 500, the tray units 200, the magazine units 100, and the like.

Figure 21:
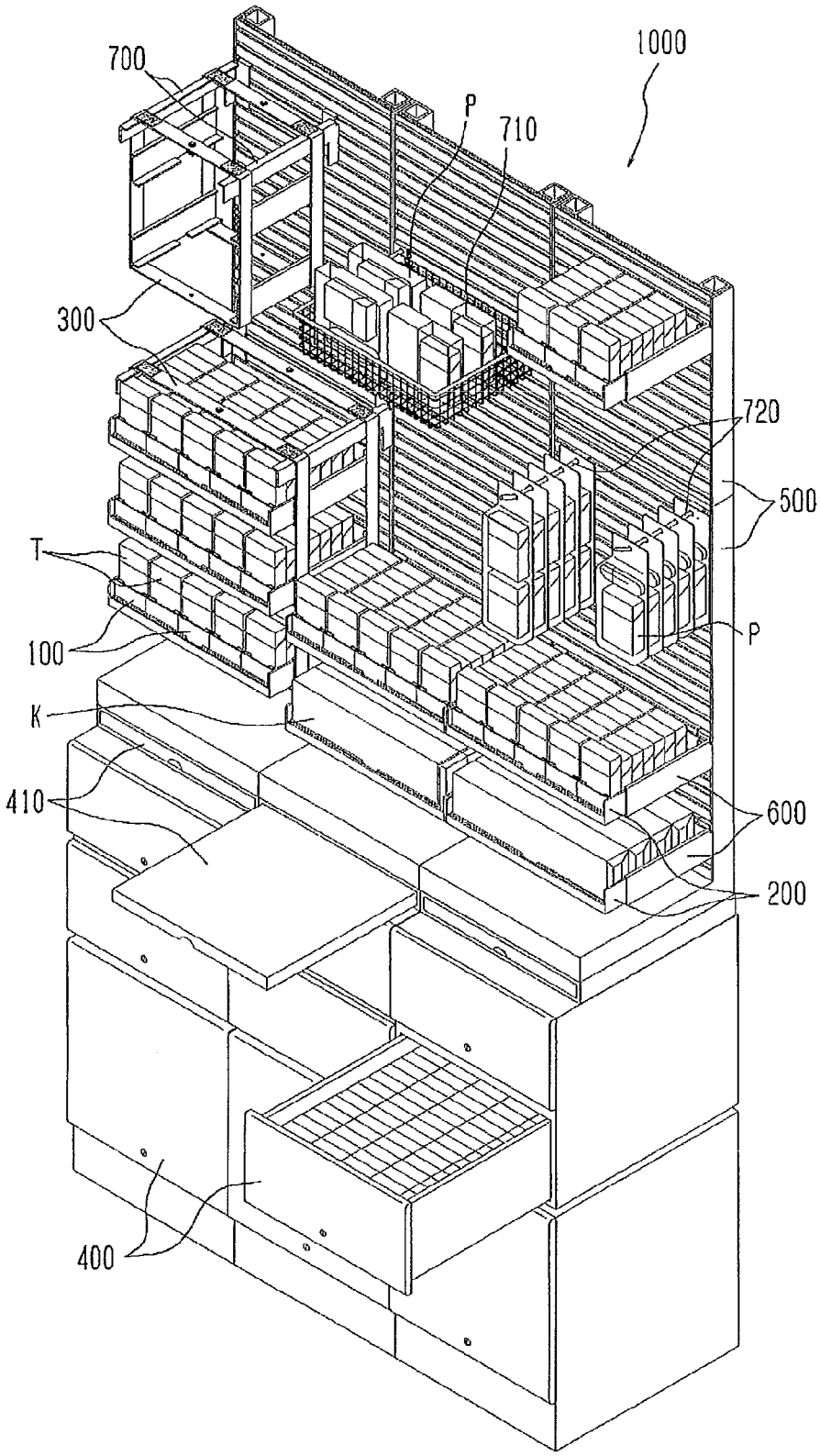
FIG. 21 is a perspective view showing an appearance of a modification of the cigarette display system having stocker units.
Figure 24:
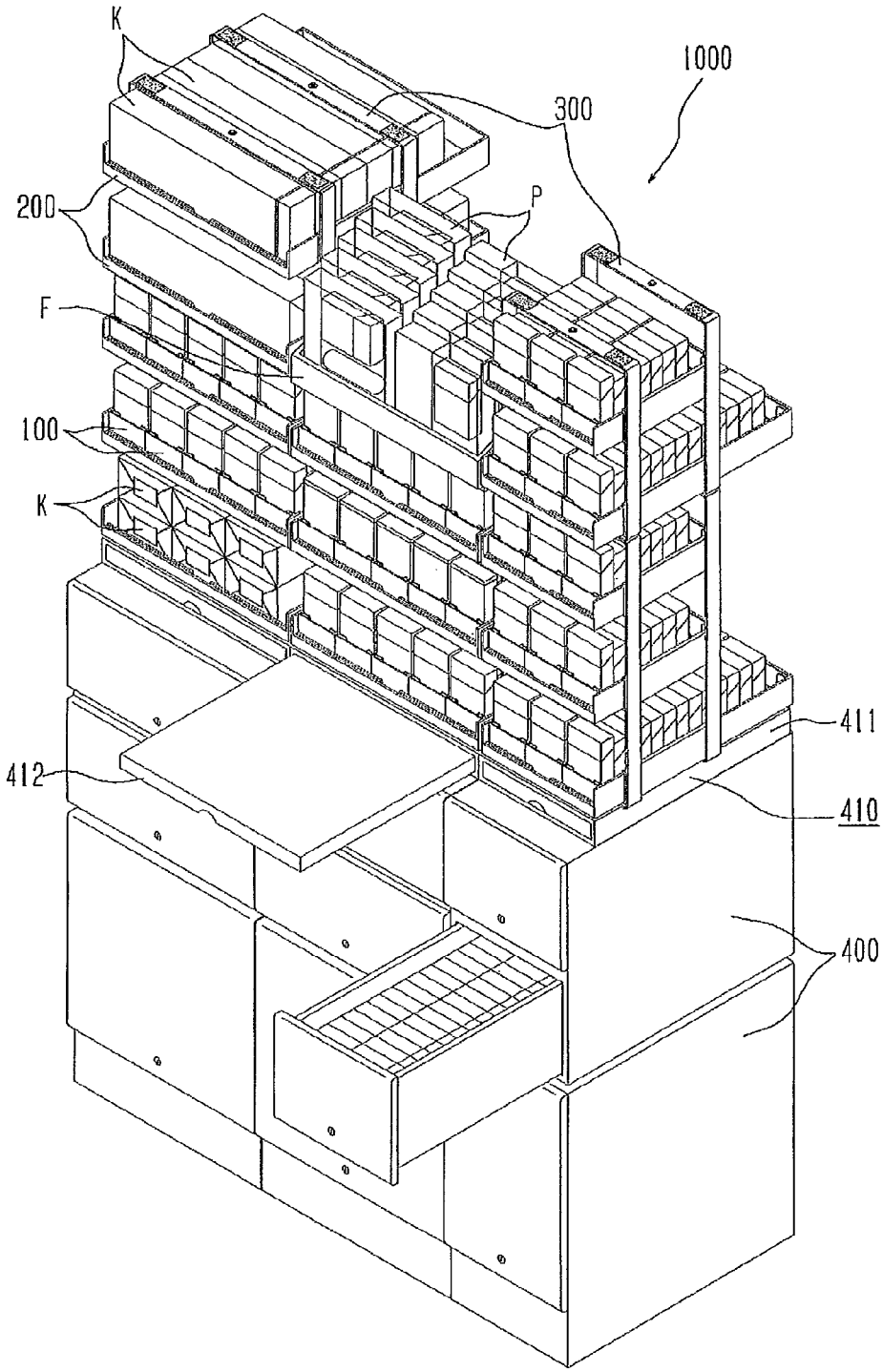
FIG. 24 is a perspective view showing an appearance of another modification of the cigarette display system having stocker units by using the frame units.

However, as shown in FIGS. 21 and 24, the cigarette display system 1000 can further includes stocker units 400 and table units 410. The stocker unit 400 is formed in the shape of a box having at least a flat top surface and a front surface, which can be opened and closed.

The table unit 410 is formed in the shape of a vertically flattened box having a flat top surface. In the table unit 410, a table part 412 is accommodated in a unit box 411 while allowing sliding movement of the table part 412 in a direction from front to back. Accordingly, it is possible to protrude the table part 412 forward and use it for a work.

The above mentioned stocker unit 400 and the table unit 410 are formed to have a lateral width which corresponds to that of the wall unit 500. Thereby, the cigarette display system 1000, as a whole, can have an appearance of unity, and generation of dead space can be prevented effectively.

By using the stoker units 400 as mentioned above, the cigarette display system 1000 can be installed in a suitable condition even in a space having no counter. Furthermore, by using the table units 410 as mentioned above, it is possible to increase operational efficiency when replenishing the cigarette packs T, and at the same time the table units 410 are not cumbersome when not in use.

Further, in the above embodiment, it is exemplified that the whole cigarette display system 1000 is formed by the wall units 500, and the cigarette packs T are displayed on the front surface of the wall units 500 using the frame units 300 and the like.

However, it is possible to form the whole cigarette display system 1000 by using the frame units 300. More specifically, as shown in FIGS. 17 to 20, in the frame unit 300, surface fasteners 311, which serve as frame link mechanisms, are attached on both sides of top surfaces and bottom surfaces of the main frames 310.

At the center of the bottom surface of the main frame 310, a frame through-hole 313, which serves as a frame concave part, is formed. At the center of the top surface of the main frame 310, a protrusion part 314, which serves as a frame convex part, is attached.

Accordingly, when installing a plurality of frame units 300 having a same lateral width, the plurality of frame units 300 are linked by the surface fasteners 311. At this time, the frame through-holes 313 engage with the protrusion parts 314.

Figure 22:
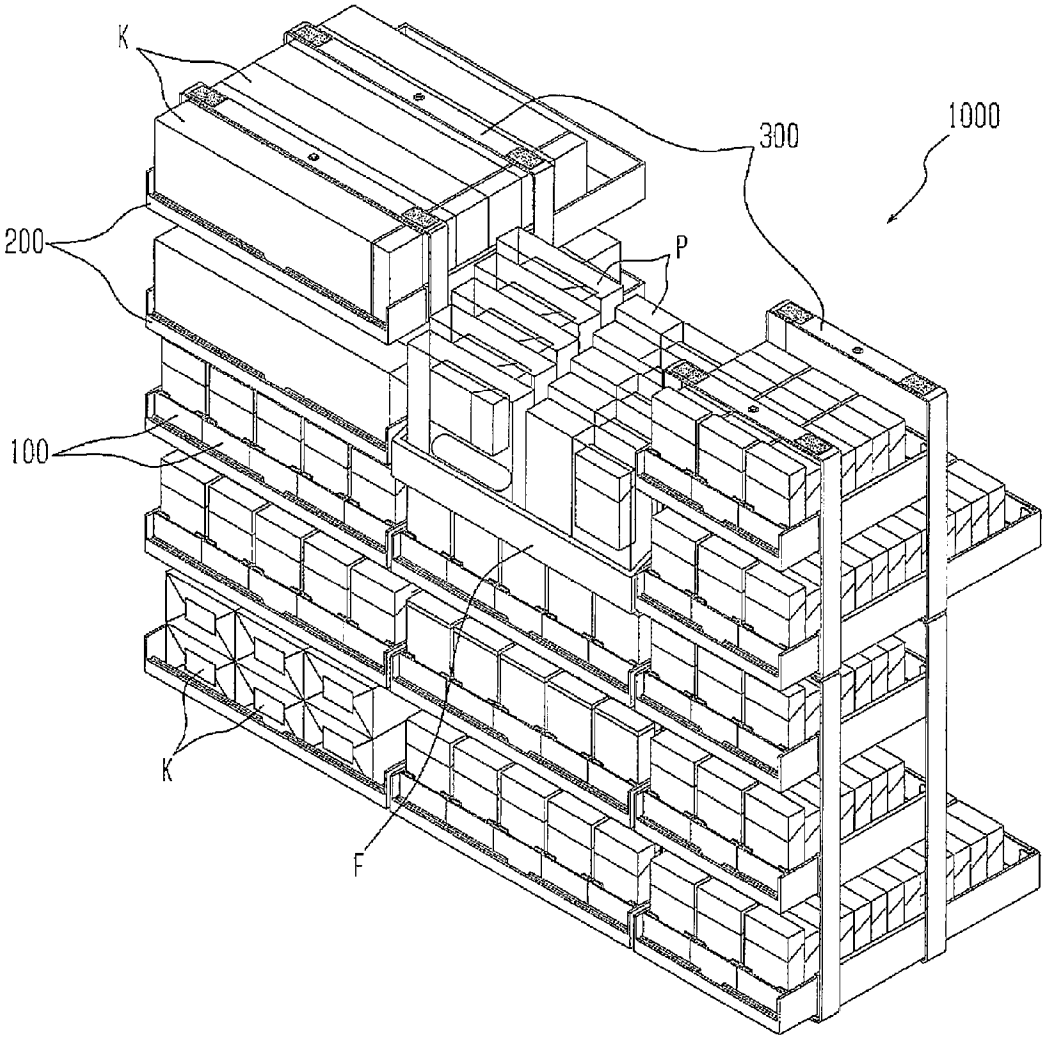
FIG. 22 is an exploded perspective view showing an appearance of another modification of the cigarette display system which is formed by the frame units.

As shown in FIG. 22, the cigarette display system 1000 can be also formed by arranging the frame units 300, which are linked in the vertical direction, in the lateral direction and mounting the tray units 200 and the magazine units 100 in the frame units 300.

As mentioned above, the guide concave part 321 with which the tray protrusion 201 of the tray unit 200 engages is formed in the support frame 320 of the frame unit 300. Here, as mentioned above, although there are two types of lengths from front to back for the tray units 200, the lengths from their front surfaces to the tray protrusions 201 are common.

Figure 23:
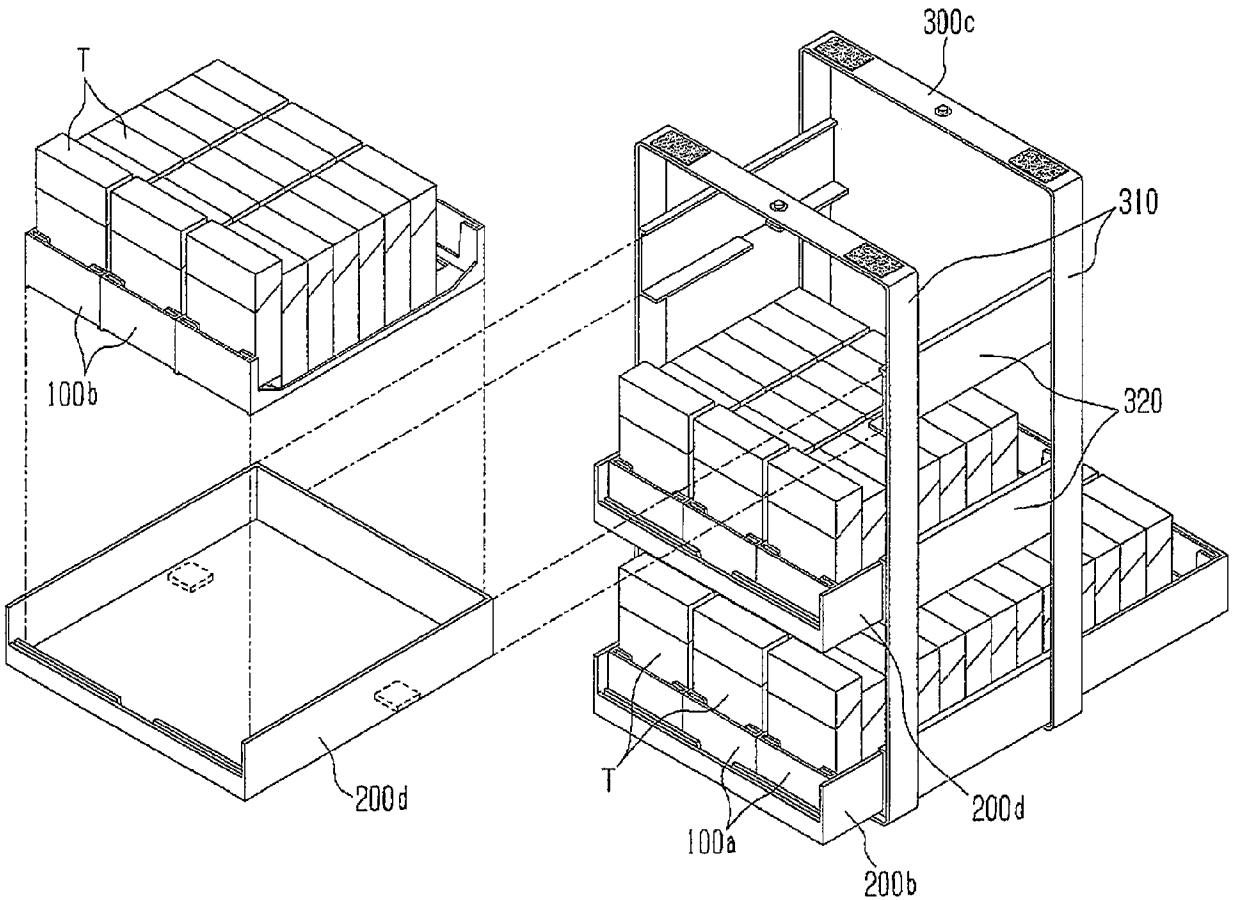
FIG. 23 is an exploded perspective view showing a condition in which tray units where the cigarette packs are accommodated by magazine units are being set into one of the four types of frame units.

Further, as for the four types of frame units 300, the length from each front surface to the guide concave part 321 is common. Accordingly, as shown in FIGS. 22 and 23, the positions of the front surfaces of the tray units 200 held by the frame units 300 are lined up in well-positioned to be flash-fitting.

In other words, as mentioned above, when the tray unit 200 is held by the frame unit 300 which is attached to the wall unit 500 by the frame attachment 700, the tray units 200*a*, 200*b* which have the long length from front to back are not used, but the tray units 200*c*, 200*d* which have the short length from front to back are used.

Also in the cigarette display system 1000 which is formed by the frame units 300 as mentioned above, a user can freely make a combination of the four types of frame units 300*a* to 300*d*, the four types of tray units 200*a* to 200*d*, and the two types of magazine units 100*a* and 100*b*, as desired.

In addition, it is possible to set up the cigarette display system 1000 (not shown) by juxtaposing the above system constituted by the frame units 300 and the system constituted by the wall units 500.

Furthermore, as shown in FIG. 24, the cigarette display system 1000 which is formed by the frame units 300 can further include the stocker units 400 and the table units 410.

In this case, since the frame units 300 are formed to have the two types of lateral widths, it is preferred that the stocker units 400 and the table units 410 are formed to have two types of lateral widths corresponding to those of the frame units 300.

In the above mentioned cigarette display system 1000, the tray units 200 and the magazine units 100 can be used in common as a result of the wall units 500 and the frame units 300 constituting the entire system.

Therefore, a manufacturer which produces the cigarette display system 1000 can increase the productivity. Especially, when the cigarette display system 1000 is formed by the wall units 500, the frame units 300 can be used as parts.

Furthermore, a store which uses the cigarette display system 1000 can continue to use the tray units 200 and magazine units 100, even when the store changes from the use of the wall units 500 to the use of the frame units 300 or vice versa.

When the cigarette display system 1000 which is set up by the frame units 300 are used in some of a plurality of sales spaces and the cigarette display system 1000 which is set up by the wall units 500 are used in the other sales spaces, the tray units 200 and the magazine units 100 can be commonly used by both of the cigarette display systems 1000.

Further, in the above embodiment, it is exemplified that the slider member 110 which pushes the cigarette packs T forward by the resilient force of the plate spring 111 is attached to the magazine unit 100, and the cigarette cartons K can be directly accommodated in the tray unit 200.

However, the slider member 110 which pushes the cigarette cartons K forward by the resilient force of the plate spring 111 can be mounted in the tray unit 200. In that case, as shown in FIGS. 25 and 26, slider units 430 detachably attached to the tray unit 200 are prepared.

Figure 25:
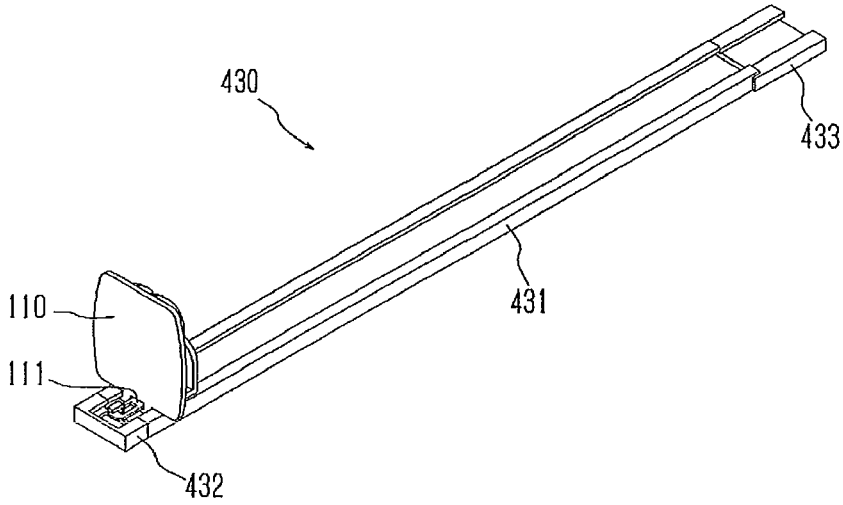
FIG. 25 is a perspective view showing appearances of a slider unit of another modification.

As shown in FIG. 25, in the slider unit 430, resin parts 432, 433 are attached to the front and back end of the guide rail 431. The slider member 110 is supported by the guide rail 431 to allow sliding movement, and one end of the plate spring 111 wound at the rear of the slider member 110 is linked to the front resin part 432. On the bottom surface of the resin parts 432, 433, sticking parts (not shown) which physically stick to the tray unit 200 are attached.

Figure 26:
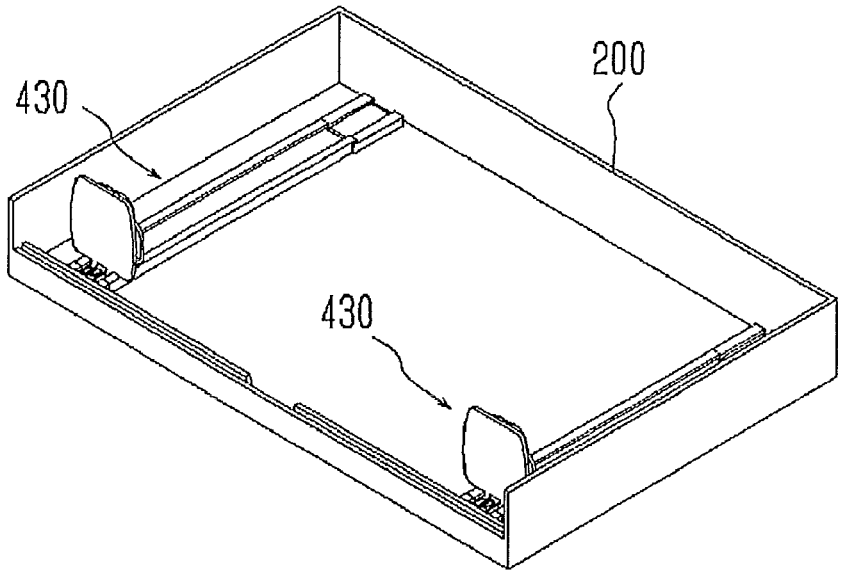
FIG. 26 is a perspective view showing a condition in which the slider units are attached to a tray unit.

Therefore, as shown in FIG. 26, by attaching a pair of the slider units 430 to the bottom surface of the tray unit 200, it is possible to push a plurality of cigarette cartons K forward accommodated in the tray unit 200 so that the cigarette carton K can be constantly located at the front end of the tray unit 200.

Figure 27:
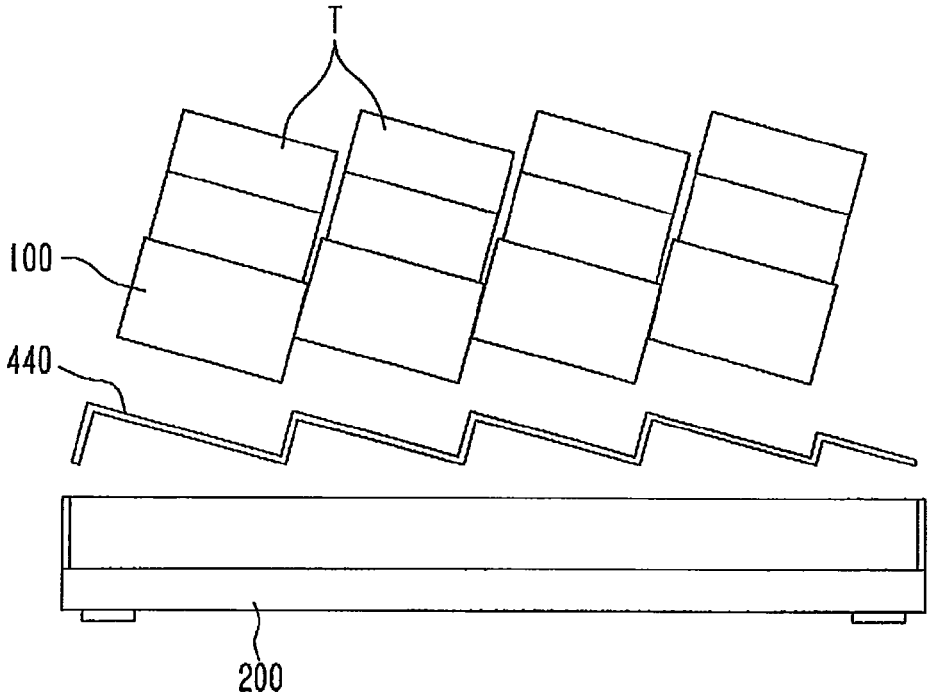
FIG. 27 is a plan view showing a condition of still another modification in which cigarette packs are being accommodated in a tray unit using a resin panel.
Figure 27:
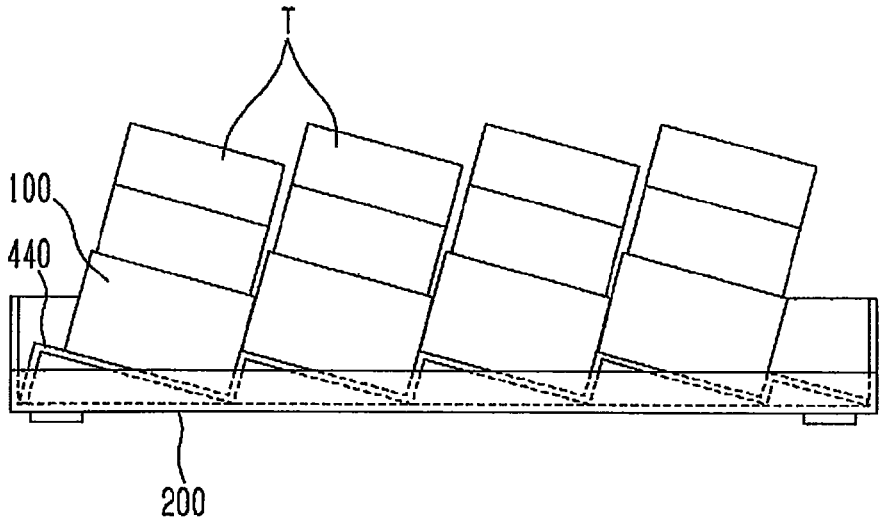

In the above embodiment, it is exemplified that the cigarette packs T are accommodated in the tray unit 200 in an upright condition using the magazine units 100. However, as shown in FIG. 27, it is possible to set a resin panel 440 having a bent shape into a waveform or the like on the bottom surface of the tray unit 200, and accommodate the cigarette packs T with the magazine units 100 in a slant condition into the tray unit 200.

In this case, since only four columns of cigarette packs T can be accommodated in the tray unit 200 which can accommodate five columns of cigarette packs T, the accommodation efficiency decreases. However, it is possible to make variations to the display of the cigarette packs T.

Further, in the above embodiment, it is exemplified that the magazine units 100 and the tray units 200 are formed by a colorless, transparent resin. However, the magazine units 100 or the like may be formed by a fluorescent colored resin.

In that case, for example, it is possible to accommodate and display general cigarette packs T in colorless, transparent magazine units 100, and accommodate and display newly marketed cigarette packs T in fluorescent colored magazine units 100. In this case, it is possible to favorably attract attention to specific cigarette packs T.

At present, when the cigarette pack T displayed in the cigarette display system 1000 is sold, the sales information is collected by an electronic cash register (not shown). Further, when the cigarette packs T or the like are replenished in the cigarette display system 1000, the replenishment information and inventory information are collected by a handy terminal (not shown) or the like.

However, it is also possible to provide function for collecting such sales information, replenishment information, and inventory information to the cigarette display system 1000. For example, at present, it is considered to mount an RFID (Radio Frequency Identification) chip (not shown) on various commodities such as the cigarette packs T.

Accordingly, installing an RFID reader (not shown) in the cigarette display system 1000 makes it possible to collect the sales information, the replenishment information, and the inventory information of the cigarette display system 1000.

For example, the RFID reader as mentioned above can be installed in the magazine unit 100, the tray unit 200, the frame unit 300, and the like, and also it may be a unit detachably attached to the magazine unit 100, the tray unit 200, the frame unit 300, and the like.

When providing the cigarette display system 1000 to a store, it is obvious that a combination of necessary units 100, 200, 500, and the like is different in each store. In that case, necessary units from 100 to, and the like are considered at store side. It is possible to provide a display simulator 800 to support the consideration to the store.

Figure 28:
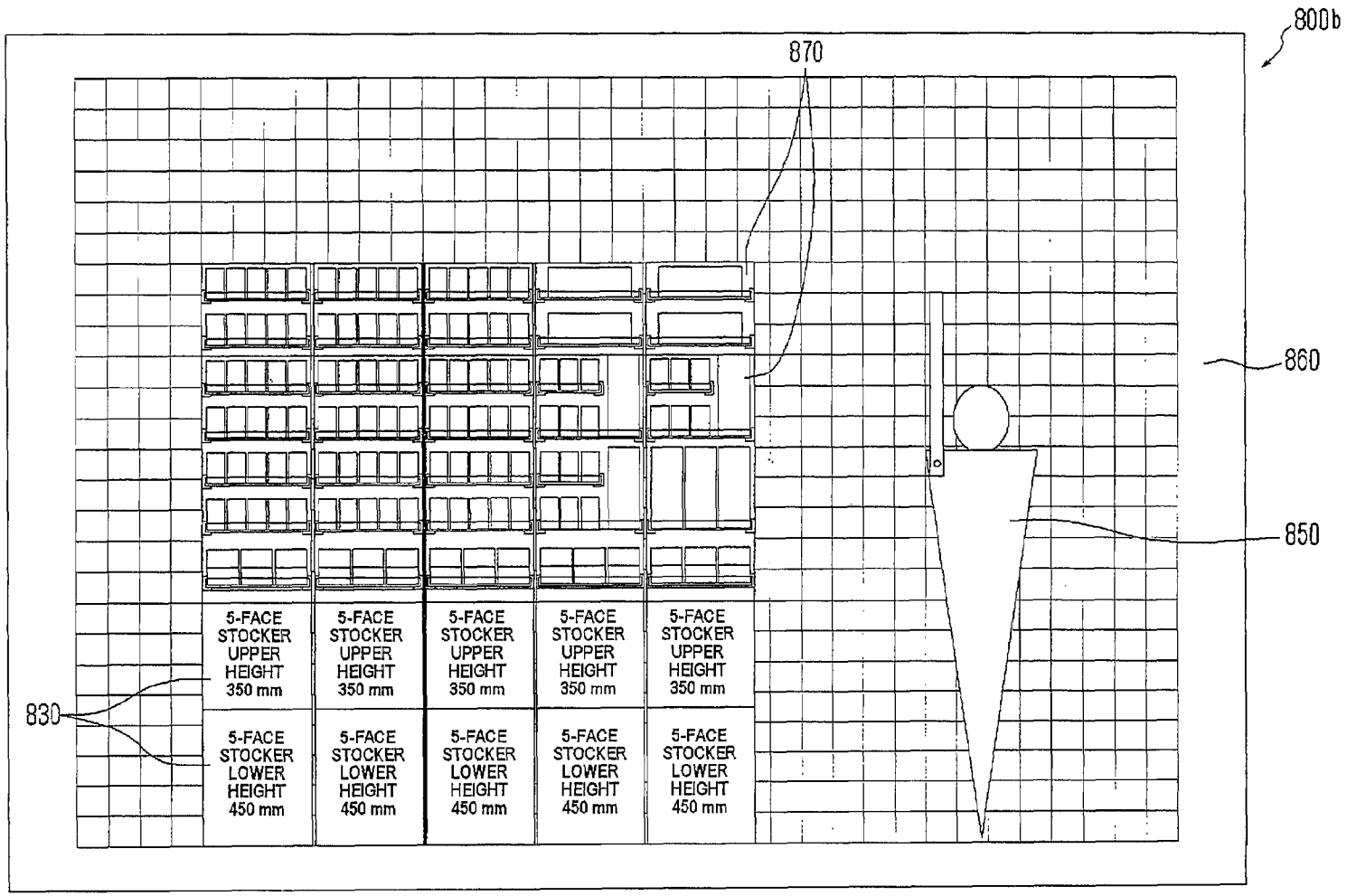
FIG. 28 is a plan view showing an appearance of a display simulator of still another modification.
Figure 29:
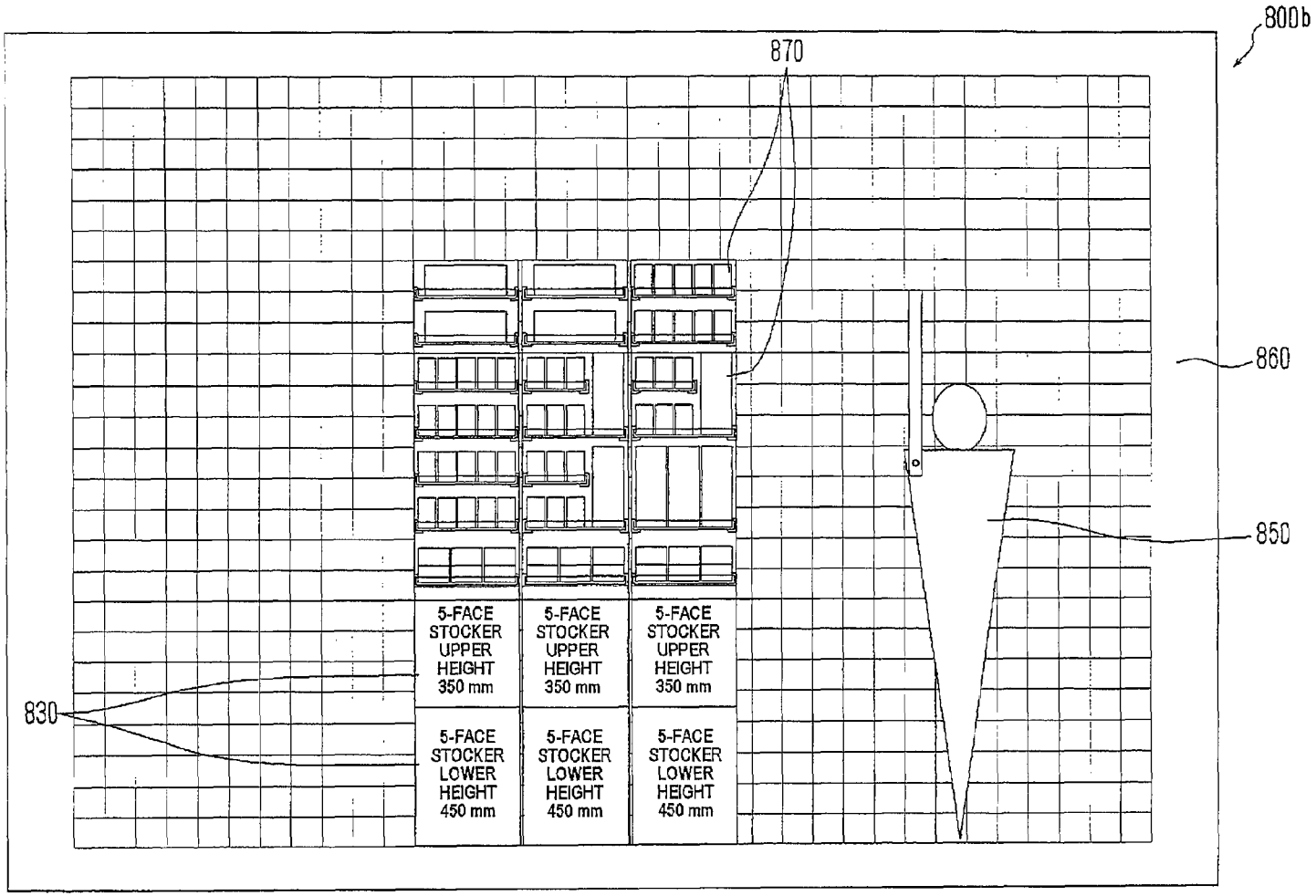
FIG. 29 is a plan view showing a condition in which the display simulator is used.

Such a display simulator 800*b* as shown in FIGS. 28 and 29, includes: flat plate unit models 870 simulating the front surface shape of the wall units 500 on a predetermined scale; stocker models 830 simulating the front surface shape of the stocker units 400 on the same scale of that of the unit models 870; a flat plate human model 850 simulating a front surface shape of a person on the same scale; a layout board 860 on which the plurality of models 830, 850, 870 are laid out and detachably attached and at the same time the human model is detachably attached; and the like, for example.

The layout board 860 is formed by a magnetic sheet and the model 870 is formed by a magnet sheet. In a store to which such a display simulator 800*b* is provided, by laying out various models 830, 850, 870 on the layout board 860, as shown in FIG. 29, it is possible to consider a combination of various units 100 to 500 and the like of the cigarette display system 1000.

In addition, since this display simulator 800*b* includes the human model 850 on a unified scale, it is possible to check a relative relationship between the cigarette display system 1000 and a person.

Especially, the human model 850 is formed so that an arm part is rotatable. Accordingly, it is possible to check whether the cigarette display system 1000 can be set up within an area in which a person operates.

Furthermore, it is possible that a manufacturer of the cigarette display system 1000 collects the display simulator 800*b* in which various models 830, 850, 870 are laid out on the layout board 860 in a store, and then provides various units 100 to 500 and the like to the store corresponding to the layout.

Figure 30:
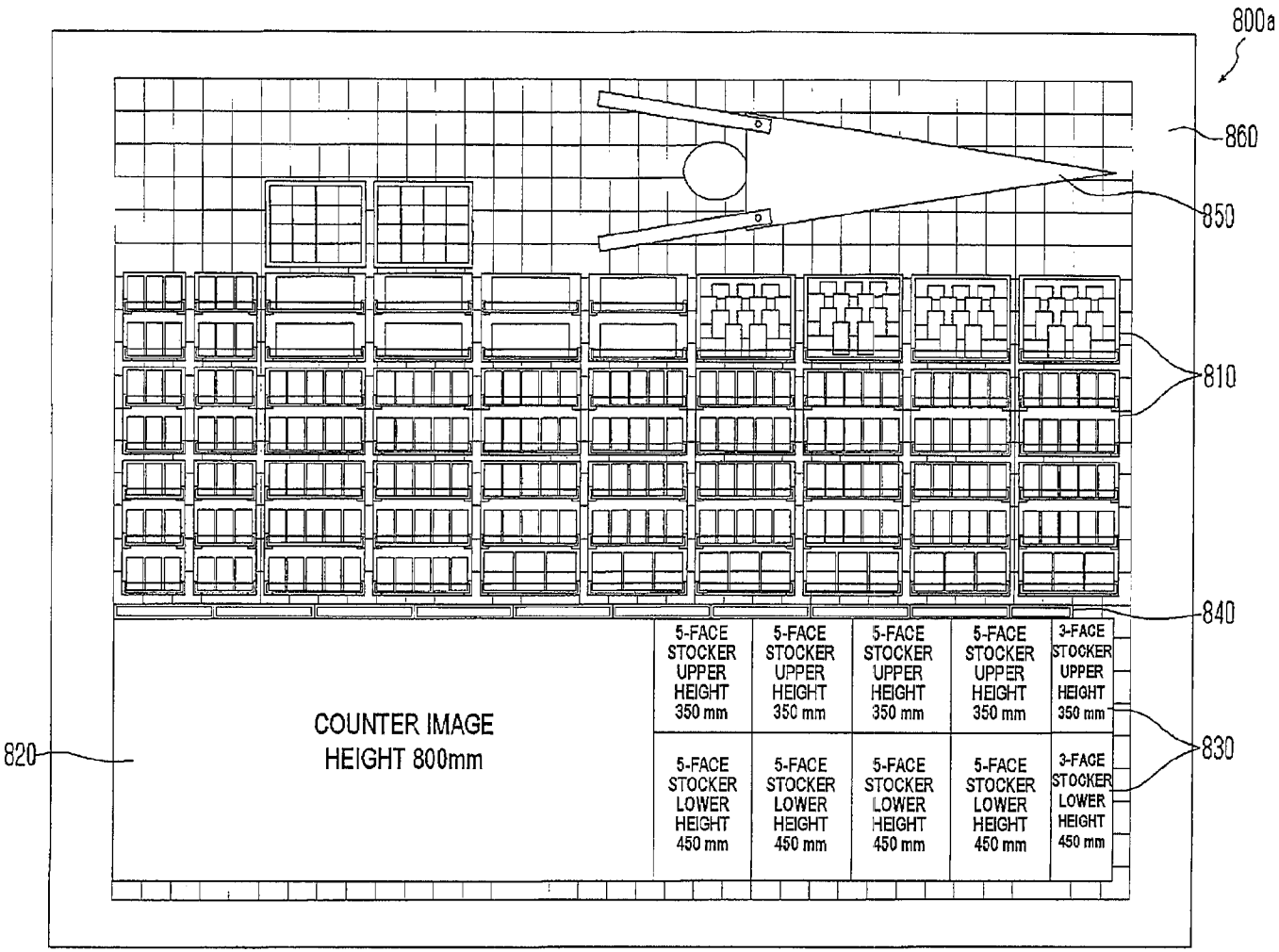
FIG. 30 is a plan view showing an appearance of a display simulator of still another modification.

Of course, as shown in FIG. 30, it is possible, in the same way, to form a display simulator 800*a* including: flat plate unit models 810 simulating the front surface shape of the frame units 300 on a predetermined scale; a counter model 820 simulating a front surface shape of a store counter (not shown) on the same scale; table models 840 simulating a front surface shape of the table units 410 on the same scale; and the like.

The invention claimed is:

1. A cigarette display system for displaying cigarette packs to be sold, said system comprising:

a plurality of magazine units formed in the shape of a box which is elongated in a direction from front to back and having an opened top, said plurality of magazine units having a shape which allows a plurality of cigarette packs to be held therein while being arranged in a direction from front to back;

a plurality of tray units formed in the shape of a box having an opened top, each of the plurality of tray units having a shape for detachably holding the plurality of magazine units arranged in the lateral direction;

a plurality of wall units which is formed in a flat plate shape flattened in a direction from front to back and has a front surface on which recesses and protrusions of a predetermined shape are formed;

a wall link mechanism for linking a plurality of said wall units in the vertical direction; and a plurality of tray attachments, wherein each of the plurality of tray attachments includes an engagement mechanism for detachably engaging with said recesses and protrusions of said wall units, and a pair of support frames for detachably holding said tray unit, wherein each of said pair of support frames is made of a metal plate elongated in a direction from front to back, and includes two edge faces formed by bending both end sides of a width direction of the support frame in a common direction, and wherein said pair of support frames support a bottom surface of said tray unit with one of the two edge faces.

2. The cigarette display system according to claim 1, wherein said magazine units include a plurality of types of magazine units whose lengths from front to back are different from one another corresponding to the number of said cigarette packs to be held, and said tray units include a plurality of types of tray units whose lengths from front to back are different from one another corresponding to said plurality of types of said magazine units.

3. The cigarette display system according to claim 1, wherein said tray units include a plurality of types of tray units whose lateral widths are different from one another corresponding to the number of said magazine units to be held, and said tray attachments include a plurality of types of tray attachments whose lateral widths are different from one another corresponding to said plurality of types of said tray units.

4. The cigarette display system according to claim 1, further comprising:

a plurality of frame units formed in the shape of a box having an opened surface, said frame units having a shape which detachably holds a plurality of said tray units in an arrangement in which said tray units are separated apart in the vertical direction; and a frame attachment having an engagement mechanism for detachably engaging with said recesses and protrusions of said wall units and a frame suspension member which detachably suspending said frame unit.

5. The cigarette display system according to claim 3, further comprising:

a plurality of frame units formed in the shape of a box having an opened front, said frame units having a shape which detachably holds a plurality of said tray units in an arrangement in which said tray units are separated apart in the vertical direction; and a frame attachment having an engagement mechanism for detachably engaging with said recesses and protrusions of said wall units, and a frame suspension member for detachably suspending said frame units, wherein said frame unit includes a plurality of types of frame units whose lateral widths are different from one another corresponding to said plurality of types of said tray units.

6. The cigarette display system according to claim 4, wherein said frame units include a plurality of types of frame units whose heights in the vertical direction are different from one another corresponding to the number of said tray units to be held.

7. The cigarette display system according to claim 4, further comprising a frame link mechanism for linking a plurality of said frame units in the vertical direction.

8. The cigarette display system according to claim 1, further comprising:

a shaft unit having an engagement mechanism for detachably engaging with said recesses and protrusions of said wall units, and a shaft member elongated in a direction from front to back.

9. The cigarette display system according to claim 1, further comprising:

a basket unit having an engagement mechanism for detachably engaging with said recesses and protrusions of said wall units, and a basket member formed in the shape of a box having an opened top.

10. The cigarette display system according to claim 1, wherein said wall units include:

a base wall with a pedestal integrally formed at a bottom end and in which a said wall link mechanism is mounted at the top end; and a panel wall in which said wall link mechanisms are mounted at the bottom end and the top end.

11. The cigarette display system according to claim 10, further comprising a stocker unit formed in the shape of a box and having a flat top surface where a length from front to back and a lateral width are the same as for said pedestal of said base wall, said stocker unit having a front surface capable of being opened and closed.

12. The cigarette display system according to claim 1, wherein said wall units are formed in a shape in which a plurality of said recesses and protrusions each running in the lateral direction are arranged in the vertical direction at a predetermined interval.

13. The cigarette display system according to claim 1, wherein said cigarette pack is formed in a rectangular solid shape, and said tray unit is formed in a shape in which cigarette cartons are arranged in a front-to-rear direction in a manner that the side surfaces of the cigarette cartons face frontward, each of said cigarette cartons including a packaged plurality of said cigarette packs and having a rectangular solid shape.

14. The cigarette display system according to claim 1, wherein said magazine unit includes a slider member arranged on a bottom surface on which said cigarette packs are placed so as to be slidable in a direction from front to back, and an urging mechanism which resiliently urges said slider member forward, and said bottom surface is made in a flat plane without a protrusion at least in a range where sliding movement is allowed for said slider member.

15. The cigarette display system according to claim 1, further comprising a slider unit which is detachably attached to a bottom surface of said tray unit, wherein said slider unit includes:

a guide rail elongated in a direction from front to back, an attaching and removing mechanism which detachably attaches said guide rail to the bottom surface of said tray unit, a slider member which is supported by said guide rail to allow sliding movement, and an urging mechanism which resiliently urges said slider member forward.

* * * * *